US008499395B2

(12) United States Patent
Wallerstrom

(10) Patent No.: US 8,499,395 B2
(45) Date of Patent: Aug. 6, 2013

(54) DAMAGE RESISTANT BRIDGE CONSTRUCTION

(76) Inventor: Neil W. Wallerstrom, Alto, MI (US)

( * ) Notice: Subject to any disclaimer, the term of this patent is extended or adjusted under 35 U.S.C. 154(b) by 0 days.

(21) Appl. No.: 13/214,695

(22) Filed: Aug. 22, 2011

(65) Prior Publication Data

US 2012/0060306 A1 Mar. 15, 2012

Related U.S. Application Data

(60) Provisional application No. 61/381,581, filed on Sep. 10, 2010.

(51) Int. Cl.
*E01D 19/02* (2006.01)

(52) U.S. Cl.
USPC ..... 14/73.5; 14/75; 384/36

(58) Field of Classification Search
USPC ..... 52/167.1, 167.4; 14/73.5, 75; 384/36
See application file for complete search history.

(56) References Cited

U.S. PATENT DOCUMENTS 3,329,472 A * 7/1967 Donnellan et al. ..... 384/36
3,397,016 A * 8/1968 Delforce et al. ..... 384/36
3,703,014 A * 11/1972 Koester ..... 14/73.5
3,971,598 A * 7/1976 Rudge ..... 384/36
4,320,549 A * 3/1982 Greb ..... 14/73.5
5,597,239 A * 1/1997 Scaramuzza et al. ..... 384/36
5,597,240 A * 1/1997 Fyfe ..... 384/36
6,120,208 A * 9/2000 Hong ..... 404/1
8,006,339 B1 * 8/2011 Bennett ..... 14/73.5

* cited by examiner

*Primary Examiner* — Gary Hartmann

(74) *Attorney, Agent, or Firm* — Gardner, Linn, Burkhart & Flory, LLP

(57) ABSTRACT

A bridge assembly is made up of stackable components that are arranged together to span substantially any size and type of geological formation. The bridge assembly is made up of one or more support columns having respective saddle members at their upper ends. Each saddle member has a lower bearing surface that engages the support column and permits variations in their relative positioning. Each saddle member further has an upper bearing surface for receiving at least one cross beam having a lower bearing surface, which bearing surfaces permit movement between a given saddle member and the cross beams it supports. The bridge components can be pre-formed out of concrete, and are typically assembled by stacking the various components.

19 Claims, 25 Drawing Sheets

Column 2

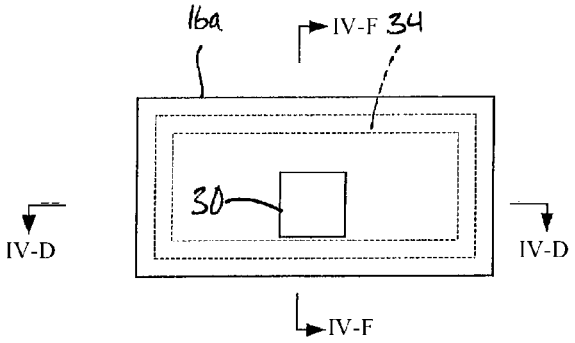
Fig. 4A
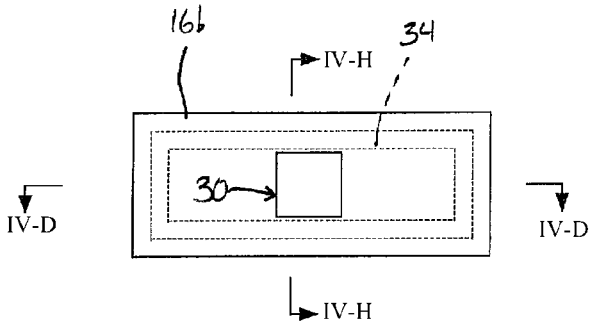
Fig. 4B
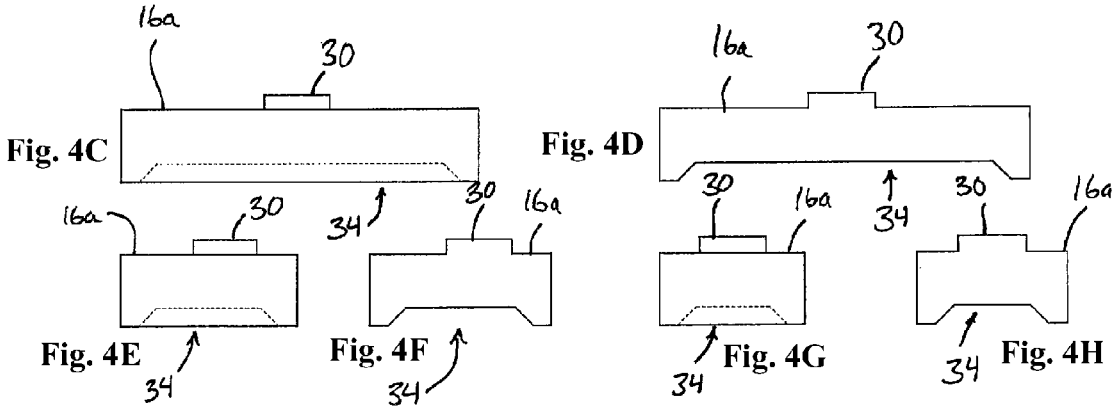
Fig. 4C
Fig. 4D
Fig. 4E
Fig. 4F
Fig. 4G
Fig. 4H

DAMAGE RESISTANT BRIDGE CONSTRUCTION

CROSS REFERENCE TO RELATED APPLICATION

The present application claims the benefit of U.S. provisional application, Ser. No. 61/381,581, filed Sep. 10, 2010, which is hereby incorporated herein by reference in its entirety.

FIELD OF THE INVENTION

The present invention relates to architectural bridges and, more particularly, to bridges for supporting roadways for vehicular and/or pedestrian traffic.

BACKGROUND OF THE INVENTION

In many areas of the world, and particularly in underdeveloped countries or regions, bridges can be used to help link remote areas together to facilitate commerce, transportation, and services. In many such places, typical traffic for roadways may include pedestrians, livestock, and motorized vehicles traveling at relatively slow speeds. Although there are many ways to design and construct bridges for use in remote locations, or for use in emergency situations, typical bridges are at least partially prefabricated in large pieces and transported by large vehicles over great distances, at high expense, and require significant planning, engineering, and preparations at the build site so that the bridge can be firmly supported and made safe. However, much of the construction effort for typical bridges for use in such applications may take place hundreds or even thousands of miles away from the build site, and it may be prohibitively expensive to transport large structural pieces over unimproved roadways. In addition, construction of such bridges may require moderately to highly skilled labor, which might not be readily available in the area where the bridge is to be built.

SUMMARY OF THE INVENTION

The present invention provides a bridge assembly for connecting and supporting roadways across geological features such as creeks and rivers, dry riverbeds, washouts, or substantially any terrain in which it would be difficult or inappropriate (such as for safety reasons) to build a roadway through the terrain, as opposed to over it. The bridge may be built from a relatively small number of types of components, most of which can be made entirely or substantially entirely of cast concrete, such as structurally reinforced concrete. Because the bridge can be made substantially entirely of relatively small sections of pre-cast concrete, regardless of its dimensions and the geological feature or features that it spans, the bridge components can be cast out of concrete substantially anywhere, and they can be readily transported in small vehicles that are able to negotiate unimproved roads. The bridge is designed to be damage resistant, such that the bridge remains at least somewhat usable even if there is some shifting of the bridge supports due to extreme flooding, use by oversized vehicles, or other rare or accidental occurrences. In the event the bridge is damaged to an unusable degree, serviceable portions of the bridge may be reused for rebuilding the bridge, while any portions that are too damaged to be reused can be replaced with new replacement portions.

Therefore, the present invention provides a damage-resistant bridge assembly that can be relatively easily and inexpensively built and/or assembled in remote areas, while remaining at least somewhat serviceable in the event of damage, and further, being rebuildable in the event that the bridge is toppled or damaged beyond serviceability.

These and other objects, advantages, purposes and features of the present invention will become apparent upon review of the following specification in conjunction with the drawings.

BRIEF DESCRIPTION OF THE DRAWINGS

FIGS. 4A and 4B are top plan views of different footers useful with the bridge of the present invention;

FIG. 4C is a side elevation of the footers of FIGS. 4A and 4B;

FIG. 4D is a side sectional view of the footers taken along lines IV-D-IV-D in FIGS. 4A and 4B;

FIG. 4E is an end elevation of the footer of FIG. 4A;

FIG. 4F is an end sectional view taken along line IV-F-IV-F in FIG. 4A;

FIG. 4G is an end elevation of the footer of FIG. 4B;

FIG. 4H is an end sectional view taken along line IV-H-IV-H in FIG. 4B;

DESCRIPTION OF THE PREFERRED EMBODIMENTS

Figure 1:
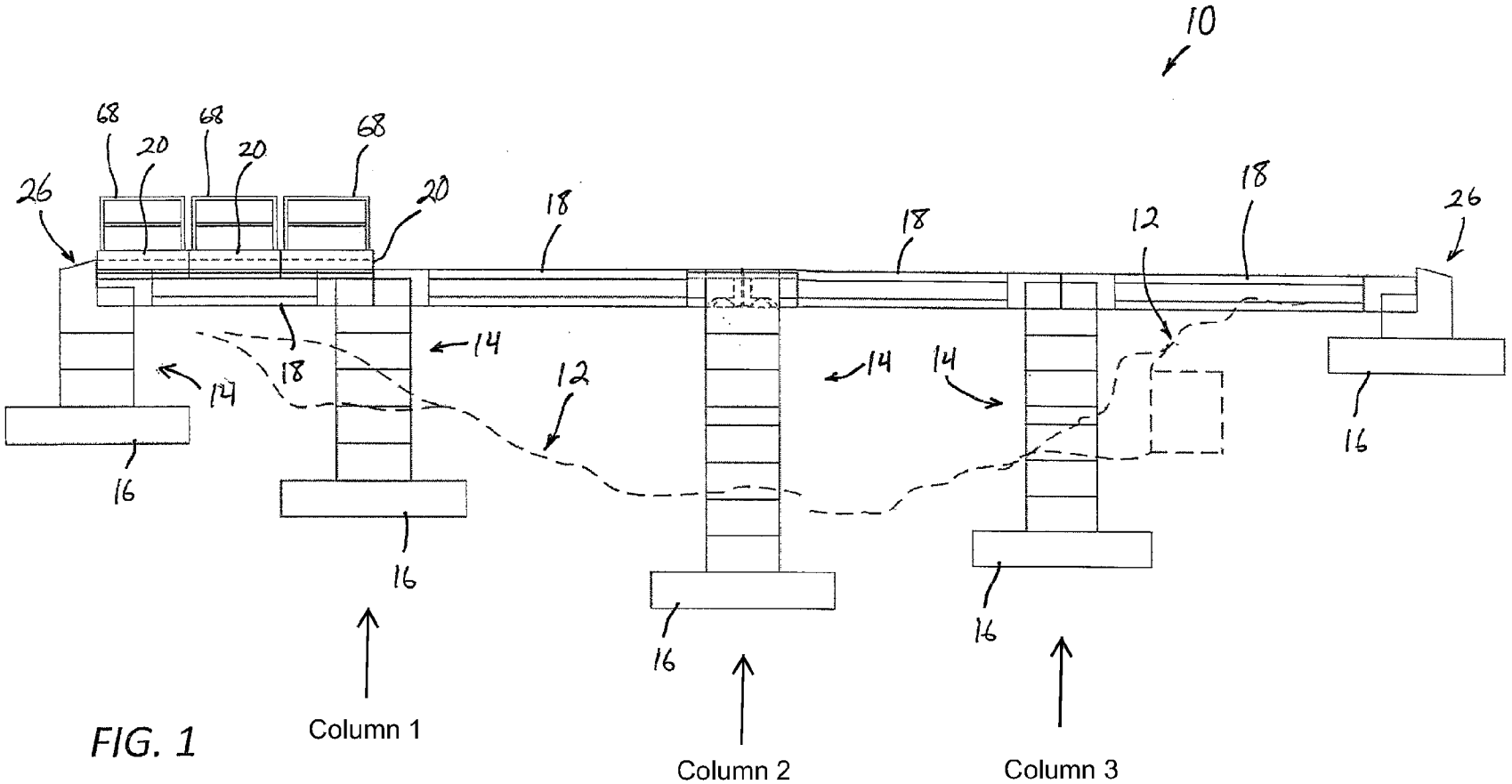
FIG. 1 is a side view of a mostly-completed bridge assembly in accordance with the present invention, shown installed across a dry riverbed.
Figure 2:
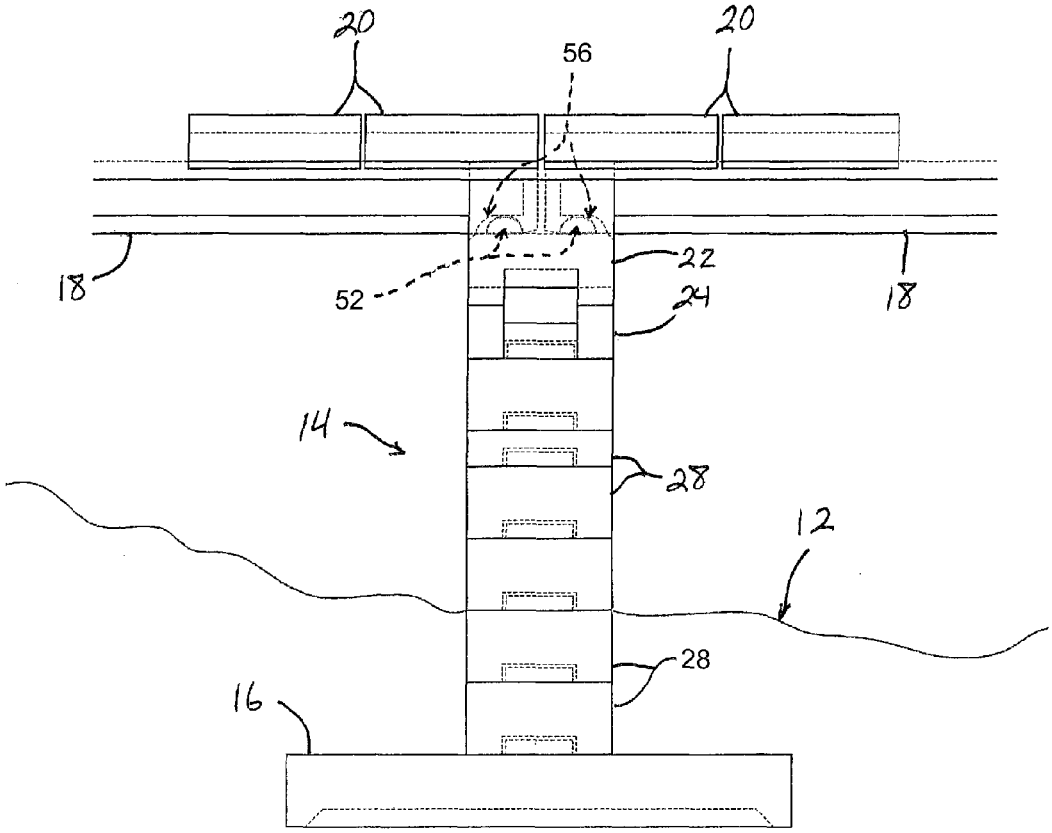
FIG. 2 is an enlarged side view of a portion of the bridge of FIG. 1.

Referring now to the drawings and the illustrated embodiments depicted therein, a bridge assembly 10 is supported along a geological feature 12 such as a riverbed, dry riverbed, wash, or the like, and made up of a relatively small number of types of individual components that rest atop one another and remain in place under gravitational loads (FIG. 1). Bridge assembly 10 is made up of support columns 14, each of which is supported on a respective footer or footer member 16, and each column 14 supporting the ends of one or more cross beams 18. The cross beams 18 support a plurality of roadway members 20, which provide a travel surface for vehicle and pedestrian traffic (FIGS. 1 and 2). Bridge assembly 10 is readily adaptable for spanning substantially any width, depth, and type of geological feature, from bedrock to sand, and is not limited in any way to the configuration shown, which is merely exemplary. As will be described in more detail below, bridge assembly 10 is made up of a relatively small number of component parts, so that the parts of the bridge can be transported by relatively small vehicles over unimproved roads, and further, the component parts are designed so that the bridge remains at least somewhat usable and serviceable in the event that one or more support columns tilts or shifts or sinks, or if the bridge is damaged in other ways.

Bridge assembly 10 further includes a saddle member 22 and a joint member 24 in stacked arrangement and positioned atop each of the support columns 14. The saddle member 22 is positioned atop the joint member 24, and both of these components support the cross beams 18. An anchor or threshold member 26 is positioned at each opposite or outboard end of bridge assembly 10, and each supports a respective outboard end of an outboard cross beam 18. Threshold members 26 may also be supported on respective footers 16, such as shown in FIG. 1.

Figure 5A:
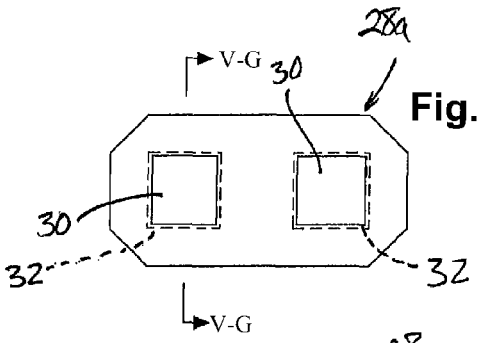
FIG. 5A is a top plan view of a riser used to construct a support column of the bridge.
Figure 5C:
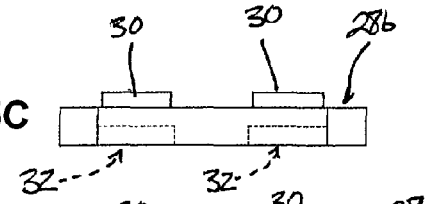
FIGS. 5B-E are end elevations of risers of varying dimensions.
Figure 5D:
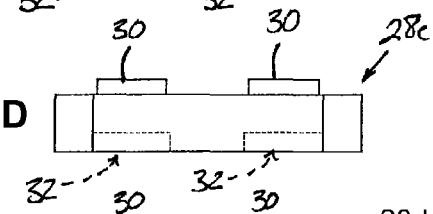
Figure 5E:
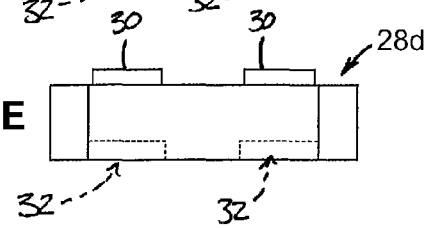
Figure 5B:
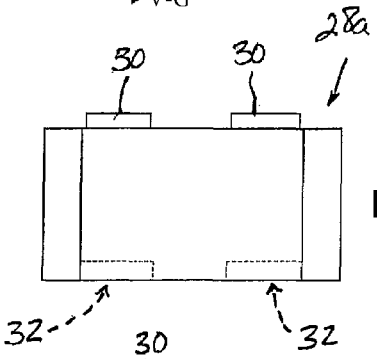
Figure 5F:
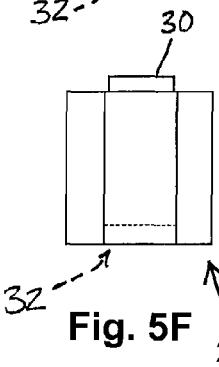
FIG. 5F is a side elevation of the riser of FIG. 5A.
Figure 5G:
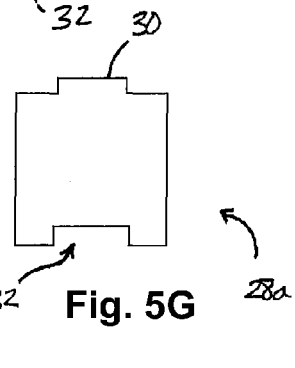
FIG. 5G is a side sectional view taken along line V-G-V-G in FIG. 5A.

Each support column 14 is typically made up of one or more risers 28 in a vertically stacked arrangement to achieve the desired height of roadway members 20. As best seen in FIGS. 2, 3, and 5A-E, the stacked risers 28 typically extend from a footer 16 up to a joint member 24. As seen in FIGS. 1 and 2, at least some of the risers 28 may be positioned below the surface of the geological feature 12 that supports bridge assembly 10. In order to achieve the desired height for a given support column 14, various combinations of risers having different heights may be selected and stacked atop one another. For example, the support column 14 of the embodiment of FIG. 3 includes three 2-foot-height risers 28*d* and one 1-foot-height riser 28*b*, to make a 7-foot tall support column before the addition of a joint member 24. Other risers may include, for example, 4-foot-height risers 28A (FIGS. 5A and 5B) and a 1.5-foot-height riser 28*c* (FIG. 5D). It will be appreciated that risers may be formed in substantially any desired height, width, and length, to allow construction of support columns having the desired strength and stability for a given bridge project.

In the illustrated embodiments, each riser 28 includes a pair of spaced rectangular or square projections 30 extending upwardly from an upper surface of the riser, and a pair of correspondingly-shaped rectangular or square recesses 32 in a lower surface of each riser. Recesses 32 are sized to be slightly larger than projections 30 so that when one riser is positioned atop another, the projections 30 of the lower riser are readily aligned with, and inserted into the corresponding recess 32 in the riser positioned above. In this manner, stacked risers are mated together so that they cannot readily shift laterally relative to one another, which also insures proper alignment and secure stacking of risers 28.

To facilitate compatibility between risers 28, footers 16, and joint members 24, it will be observed that each of these components may include respective pairs of projections 30 and slightly larger recesses 32, all having substantially the same dimensions and spacing. However, it will be appreciated that if for some reason it would not be desirable to stack one type of component atop another, the respective projections and recesses could be made non-compatible with one another, such as to prevent inappropriate or undesired stacking of certain components. For example, if certain risers were manufactured to be lighter weight but less strong than others, so that the light weight risers would only be suitable for use near the top of a support column, then the projection along the top surface of the weaker riser could be made somewhat larger than the recesses so that the incompatibility would be readily apparent to workers if another riser were positioned on top of the weakened riser.

When bridge assembly 10 is to be supported on unstable surfaces, such as substantially anything that is not bedrock, it is generally desirable to provide at least one footer 16 (and typically, at least two side-by-side footers) below the lowermost riser 28 of support column 14, to distribute the load of the bridge in that region across a larger surface area, such as shown in FIGS. 1 and 2. For example, two 5-foot-length footers 16*a* (FIG. 4A) may be arranged side-by-side, each footer 16*a* having a single projection 30 offset to one side of each footer 16*a* so that the projection 30 of each footer 16*a* will be received in a respective recess 32 of the lowermost riser 28. Optionally, and for example, 4-foot-length footers 16*b* may be used when the geological support surface is more firm. Each footer 16 may include a lower recess 34 that helps stabilize the footer on softer surfaces, such as sand, soil, gravel, or clay.

Figure 3:
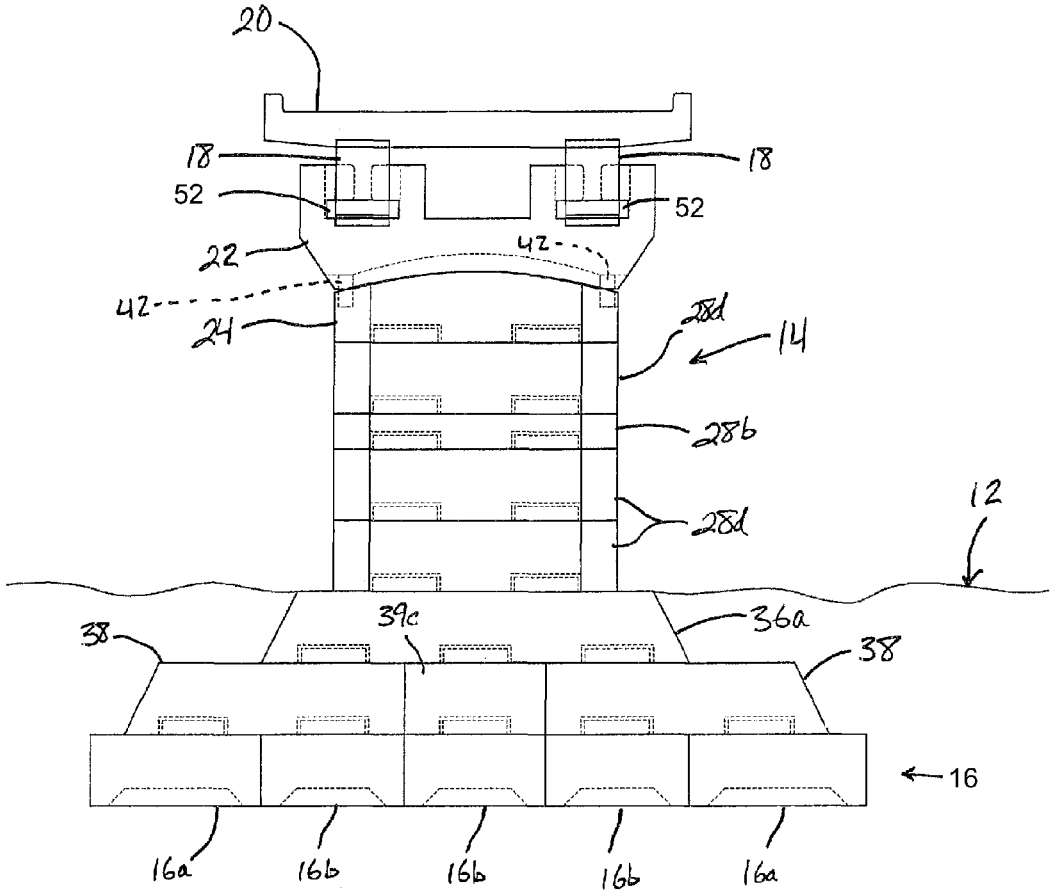
FIG. 3 is an enlarged end view of another portion of a bridge, including a roadbed and a column supported on footers.
Figure 19A:
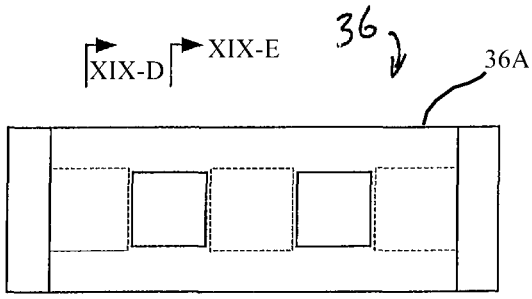
FIG. 19A is a top plan view of a footer adaptor.
Figure 19B:
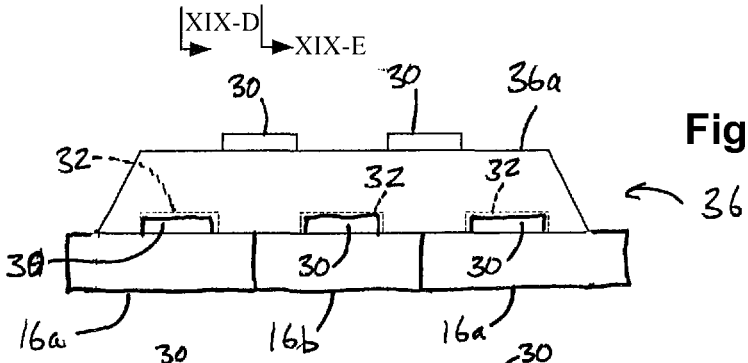
FIG. 19B is an end elevation of the footer adaptor of FIG. 19A, shown positioned atop three footers.
Figure 19C:
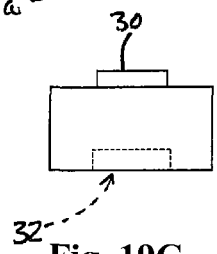
FIG. 19C is a side elevation of the footer adaptor of FIG. 19A.
Figure 19D:
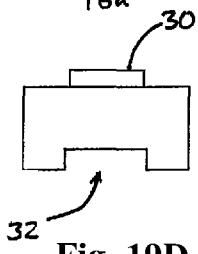
FIGS. 19D and 19E are side sectional views of the footer adaptor, taken along lines XIX-D-XIX-D and XIX-E-XIX-E, respectively, in FIG. 19A.
Figure 19E:
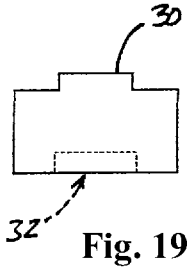
Figure 19F:
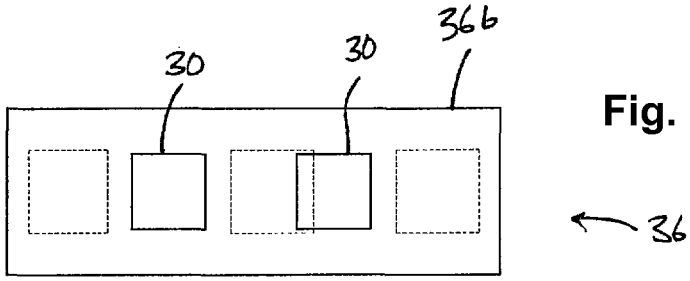
FIG. 19F is a top plan view of another footer adaptor.
Figure 19G:
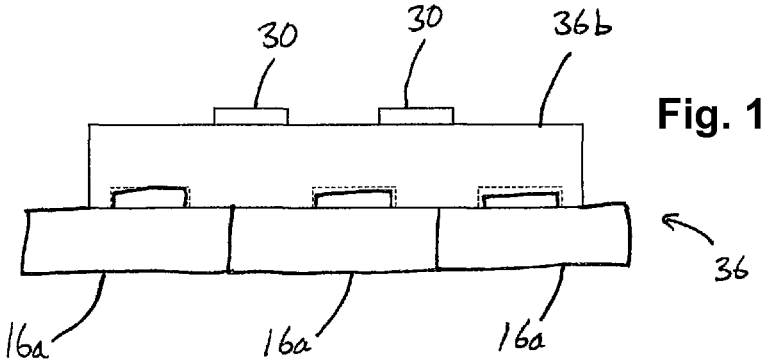
FIG. 19G is an end elevation of the footer adaptor of FIG. 19F, shown positioned atop three footers.
Figure 20A:
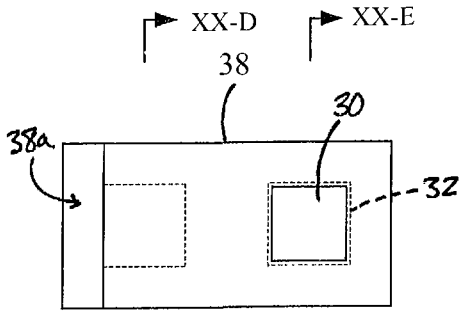
FIG. 20A is a top plan view of an expanded footer adaptor.
Figure 20B:
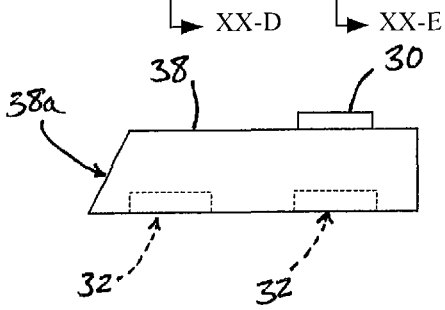
FIG. 20B is an end elevation of the expanded footer adaptor of FIG. 20A.
Figure 20C:
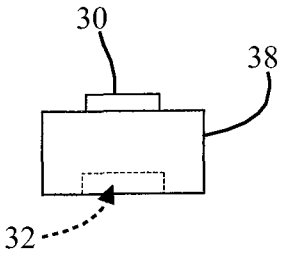
FIG. 20C is a side elevation of the expanded footer adaptor of FIG. 20A.
Figure 20D:
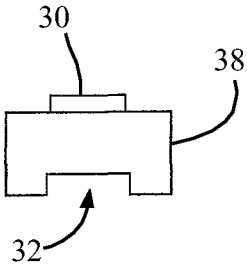
FIGS. 20D and 20E are side sectional views of the expanded footer adapter, taken along lines XX-D-XX-D and XX-E-XX-E, respectively, in FIG. 20A.
Figure 20E:
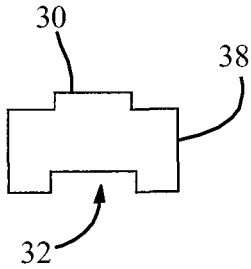

Optionally, such as when the geological support surface is particularly soft or unstable, and/or when the loads supported at each support column are expected to be particularly high, a plurality of footers (e.g. 5-foot-length footers 16*a* and 4-foot-length footers 16*b*) may be assembled together in a side-by-side arrangement, with footer adaptors 36 positioned between the footers 16 and the lowermost riser 28 (FIG. 3). Each footer adaptor 36 may be positioned below the lowermost riser 28 of a support column 14, and allows for supporting the column 14 atop three or more individual footers 16. For example, a first type of adaptor 36A (FIGS. 19A-E) allows for the weight of a column 14 to be supported across three footers 16*a*, 16*b* that are arranged crosswise relative to the first footer adaptor 36*a*, such as shown in FIG. 12B. In this arrangement, the outermost footers are 5-foot-length footers 16*a* while the middle footer is a 4-foot-length footer 16*b*. A second footer adaptor 36*b* (FIGS. 19F and 19G) allows for three 5-foot-length footers 16*a* to be positioned below the footer adaptor 36*b*, to provide a larger support area, such as shown in FIG. 19G.

Figure 21A:
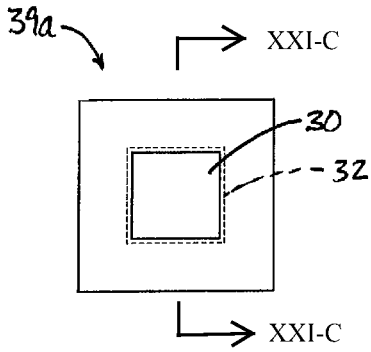
FIG. 21A is a top plan view of another expanded footer adaptor.
Figure 21B:
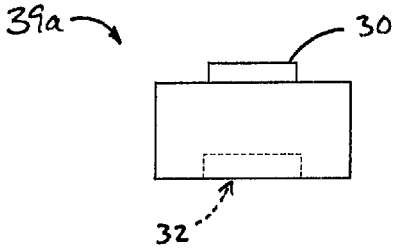
FIG. 21B is an end elevation of the expanded footer adaptor of FIG. 21A.
Figure 21C:
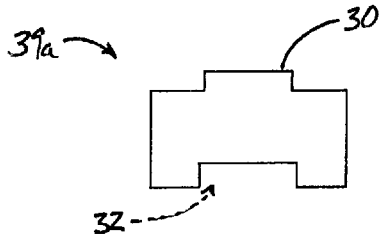
FIG. 21C is an end sectional view of the expanded footer adaptor, taken along line XXI-C-XXI-C in FIG. 21A.
Figure 22A:
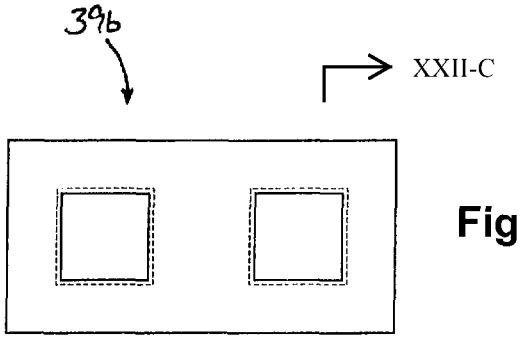
FIG. 22A is a top plan view of another expanded footer adaptor.
Figure 22B:
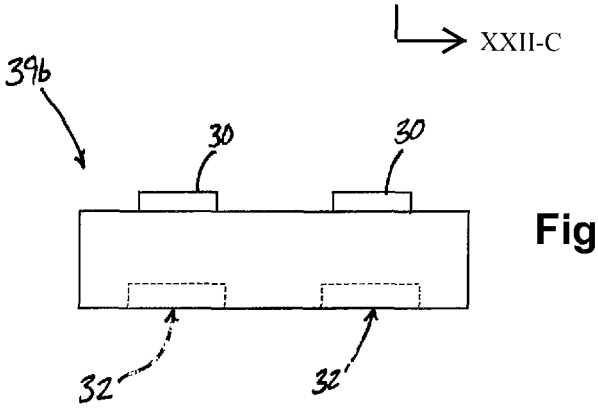
FIG. 22B is an end elevation of the expanded footer adaptor of FIG. 22A.
Figure 22C:
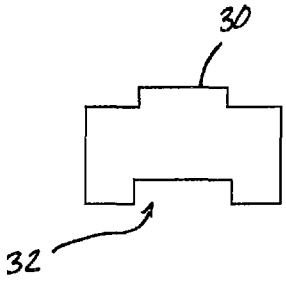
FIG. 22C is an end sectional view of the expanded footer adaptor, taken along line XXII-C-XXII-C in FIG. 22A.
Figure 23A:
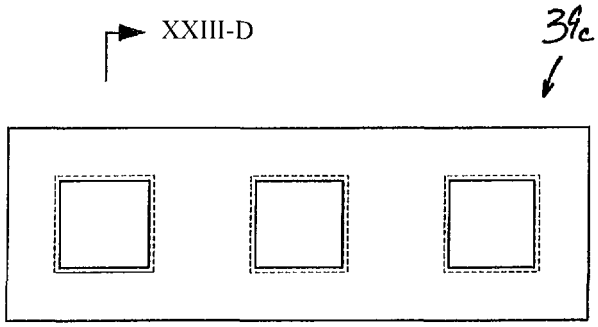
FIG. 23A is a top plan view of another expanded footer adaptor.
Figure 23B:
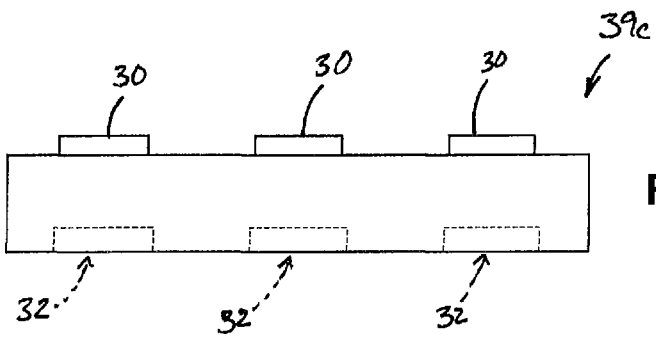
FIG. 23B is an end elevation of the expanded footer adaptor of FIG. 23A.
Figure 23C:
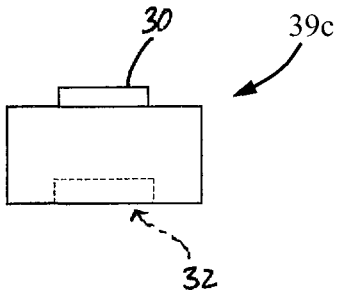
FIG. 23C is a side elevation of the expanded footer adaptor of FIG. 23A.
Figure 23D:
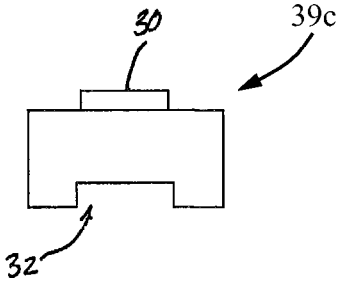
FIG. 23D is a side sectional view of the expanded footer adaptor, taken along line XXIII-D-XXIII-D in FIG. 23A.
Figure 24:
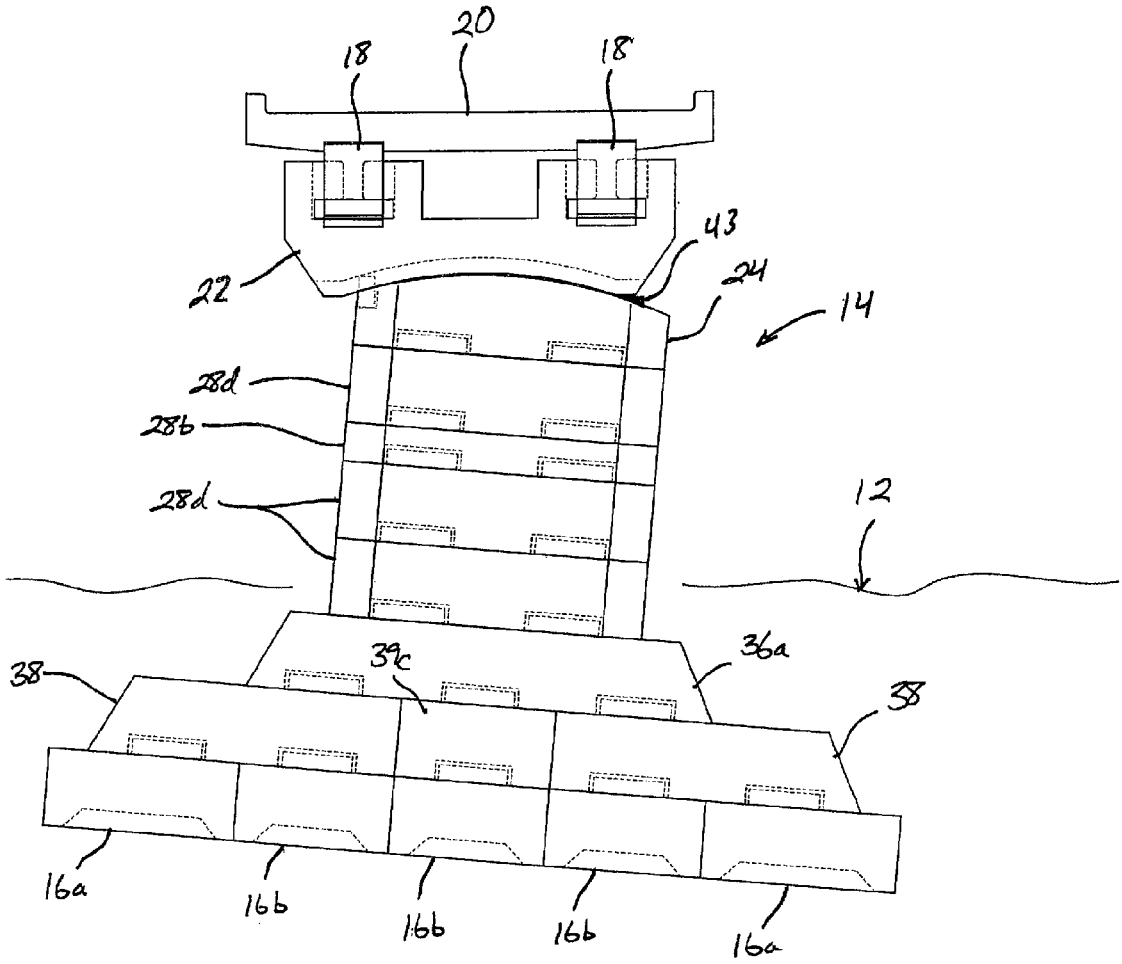
FIG. 24 is an end sectional elevation of the support column of FIG. 3, shown in a partially-sunken and tipped configuration.

The number of footers 16 used to support each support column 14 may be further expanded or increased by positioning expanded footer adaptor end pieces 38 (FIGS. 20A-20E) and/or expanded footer adaptors 39*a-c* (FIGS. 21A-23D) between footer adaptors 36 and footer 16, such as shown in FIGS. 3 and 24. Each expanded footer adaptor end piece 38 permits two footers 16 to be positioned underneath each opposite end or side of footer adaptor 36, such as shown in FIG. 3. The outer end portions 38*a* of expanded footer adaptor end pieces 38 are sloped to deflect water and facilitate drainage. Expanded footer adaptors 39*a-c* are used to fill gaps between footer adaptor end pieces 38 so that the footer and adaptors can be arranged in a common brick-laying configuration, so that seams between adjacent footers and adaptors do not align with the seams between footers and adaptors located immediately above or below. Different shapes and sizes of expanded footer adaptors may be used to fill gaps as needed. For example, footer adaptors 39*a* (FIGS. 21A-21C) are one unit wide by one unit long (i.e. square), while footer adaptors 39*b* (FIGS. 22A-22C) are one unit wide by two units long (i.e. 2×1 rectangular), and footer adaptors 39*c* (FIGS. 23A-23C) are one unit wide by three units long (i.e. 3×1 rectangular). It will be appreciated that substantially any number of footers 16, of any size and/or shape, may be positioned at or below the surface of the geological formation 12 to provide an appropriate level of support for each column 14, by using the desired number and arrangements of footer adaptors 36, and/or expanded footer adaptor end pieces 38, and/or expanded footer adaptors 39*a-c*.

Figure 6A:
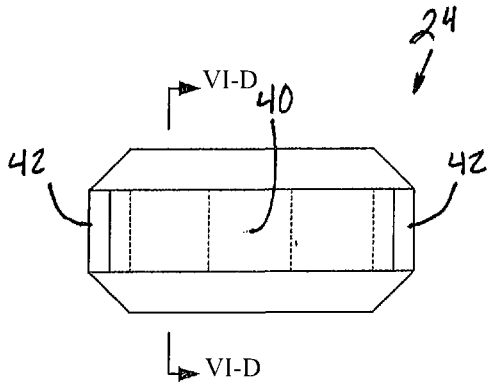
FIG. 6A is a top plan view of a joint member for use with the bridge.
Figure 6B:
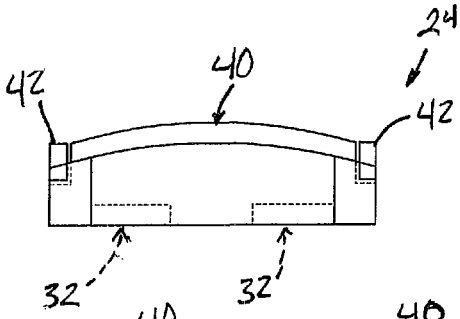
FIG. 6B is a side elevation of the joint member of FIG. 6A.
Figure 6C:
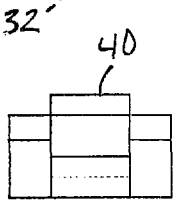
FIG. 6C is a end elevation of the joint member of FIG. 6A.
Figure 6D:
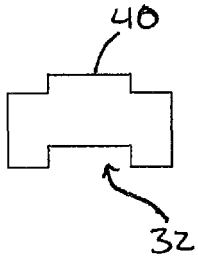
FIG. 6D is a side sectional view taken along line VI-D-VI-D in FIG. 6A.

As noted above, each support column 14 supports a joint member 24, which in turn supports a saddle member 22. Joint member 24 remains substantially fixed relative to the support column 14 and the uppermost riser 28 on which the joint member 24 is directly supported (FIGS. 2 and 3). Joint member 24 includes a convex upper bearing surface 40 and a stop block 42 positioned near each opposite end of the convex upper bearing surface 40 (FIGS. 6A and 6B). Joint member 24 supports saddle member 22 at the upper bearing surface 40, while stop blocks 42 engage generally flat lower surfaces of saddle 22 (FIG. 3). Optionally, joint members 24 may be omitted from the bridge assembly, and an alternative saddle member 22' (FIGS. 8A-8C) may be used that is configured for placement directly on top of the uppermost riser 28. Saddle member 22' lacks a concave lower bearing surface, and instead is provided with recesses 32 for engagement with projections 30 of the uppermost riser 28 of support column 14. In all other respects, the upper portion of alternative saddle member 22' may be substantially similar or identical to that of saddle member 22 of FIGS. 7A and 7B.

Figure 7A:
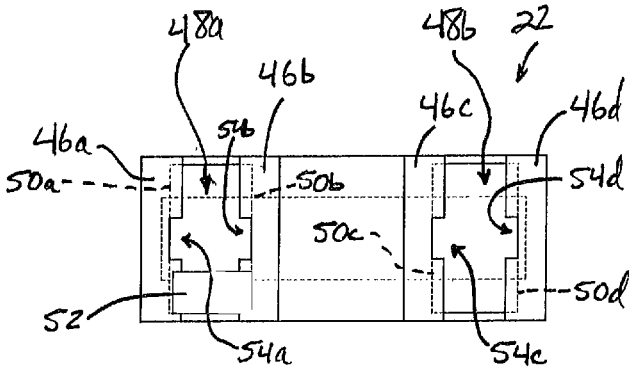
FIG. 7A is a top plan view of a saddle member.
Figure 7B:
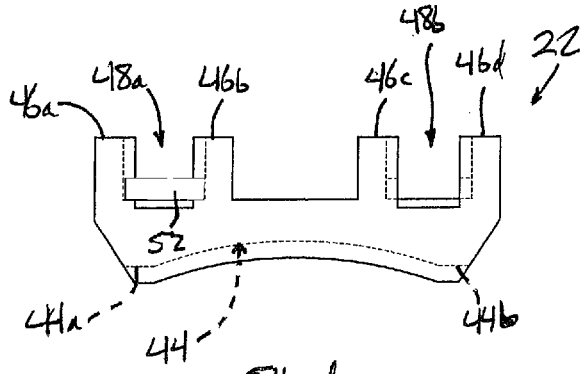
FIG. 7B is an end elevation of the saddle member of FIG. 7A.
Figure 8A:
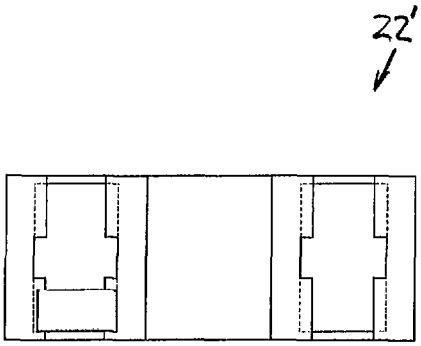
FIG. 8A is a top plan view of an alternative saddle member configured to be directly supported on an uppermost riser of a column.
Figure 8B:
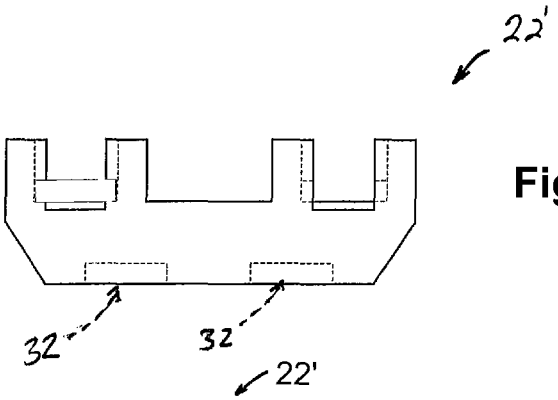
FIG. 8B is an end elevation of the saddle member of FIG. 8A.
Figure 8C:
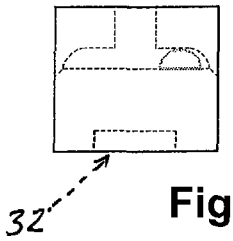
FIG. 8C is a side elevation of the saddle member of FIG. 8A.

Saddle member 22 includes a concave lower bearing surface 44 that generally corresponds in shape to the convex upper bearing surface 40 of joint member 24 (FIGS. 7A and 7B). The complementary concave lower bearing surface 44 and convex upper bearing surface 40 are arranged so that these surfaces are able to move relative to one another (such as by sliding or rolling along on rollers or bearings or the like) in generally lateral directions relative to the overall bridge assembly. A wedge 43 may be provided for insertion between the convex upper bearing surface 40 and the concave lower bearing surface 44, as desired, to stop further sliding or movement of the saddle member 22 along the joint member 24, such as shown in FIG. 24 as compared to FIG. 3, and as will be discussed in greater detail below. Opposite end portions 44*a*, 44*b* of the lower bearing surface of the saddle member 22 are shaped to engage respective stop blocks 42 in the event that saddle member 22 shifts by a predetermined maximum allowable amount atop joint member 24, such as shown in FIG. 24.

Figure 7C:
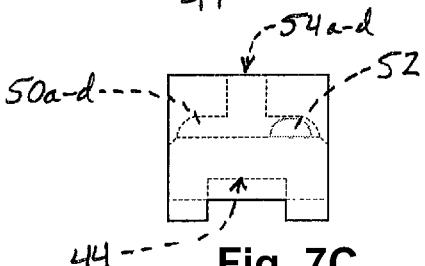
FIG. 7C is a side elevation of the saddle member of FIG. 7A.

Saddle member 22 includes an upper portion made up of four upstanding walls 46*a-d* (FIGS. 7A and 7B). Walls 46*a*, 46*b* cooperate to define a first beam-receiving channel 48*a*, while walls 46*c*, 46*d* cooperate to define a second beam-receiving channel 48*b*. Each of the upstanding walls 46*a-d* further defines a generally horizontal slot or channel 50*a-d* for slidably receiving a movable slide member 52 that is able to traverse each of the beam-receiving channels 48*a*, 48*b* in a lengthwise direction relative to the channels. Each of the upstanding walls 46*a-d* further includes a generally vertically-aligned drop-in slot 54 that permits the movable slide member 52 to be placed between the respective pairs of upstanding walls 46*a*, 46*b* and 46*c*, 46*d*, so that the slide member 52 may be positioned in and between the respective slots 50*a*, 50*b* and 50*c*, 50*d*, and so that each movable slide member 52 can traverse its respective beam-receiving channel 48*a*, 48*b*. In the illustrated embodiment, each slot 50*a-d* is closed-ended so that the movable slide members 52 cannot be removed from the saddle member 22, except through drop-in slots 54*a-d*. As will be described in more detail below, each beam-receiving channel 48*a*, 48*b* typically receives two movable slide members 52, each for engagement with a different cross beam 18. In the illustrated embodiment, each movable slide member 52 is in the form of approximately one-half of a solid cylinder having a generally flat surface facing downwardly, and having a convex surface facing upwardly, such as shown in FIG. 7C. For example, movable slide member 52 could be manufactured from one half of a concrete-filled steel pipe.

Figure 9A:
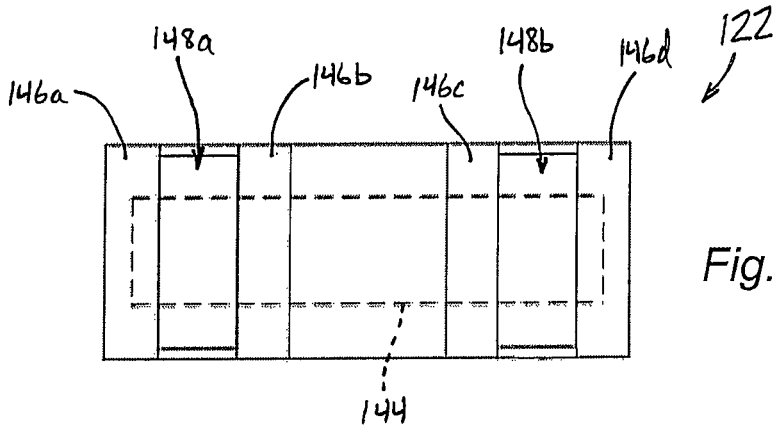
FIG. 9A is a top plan view of another alternative saddle member for directly supporting cross beams without slide members.
Figure 9B:
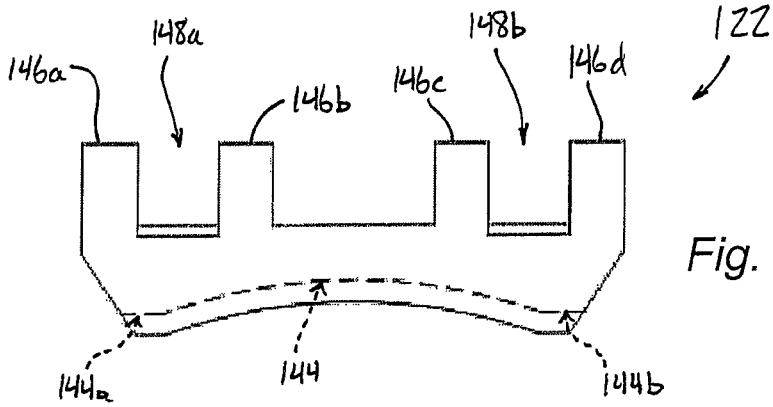
FIG. 9B is an end elevation of the saddle member of FIG. 9A.
Figure 9C:
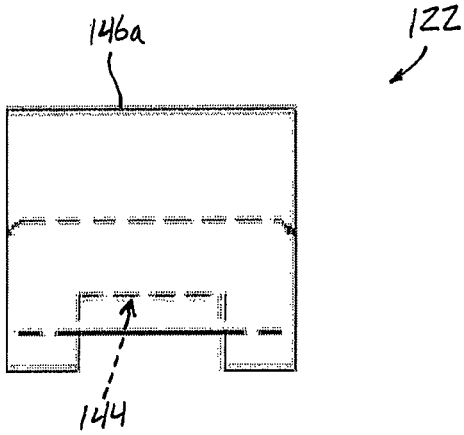
FIG. 9C is a side elevation of the saddle member of FIG. 9A.

Optionally, and with reference to FIGS. 9A-9C, an alternative saddle member 122 is similar to saddle member 22, described above, but is configured to support cross beams without the use of slide members. In FIGS. 9A-9C, various regions and components of alternative saddle member 122 that are substantially similar to regions and components of saddle member 22 are given like numerals by the addition of 100, such that the regions and components may be understood with reference to the above discussion.

Figure 10A:
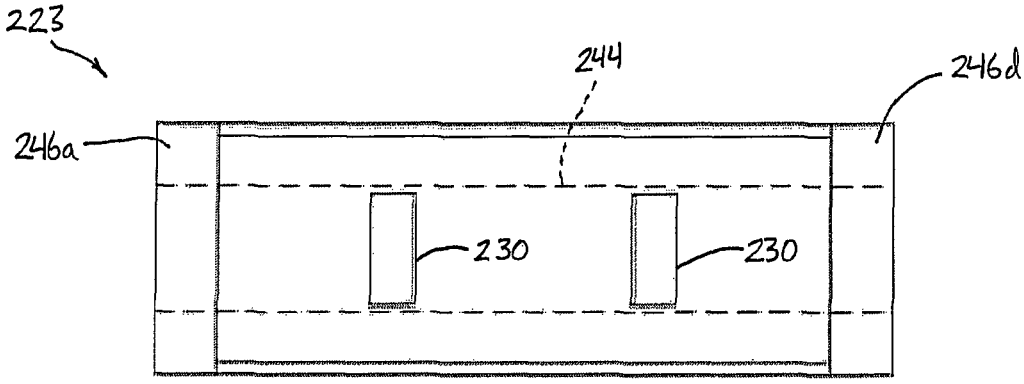
FIG. 10A is a top plan view of another alternative saddle member for directly supporting cross beams without slide members.
Figure 10B:
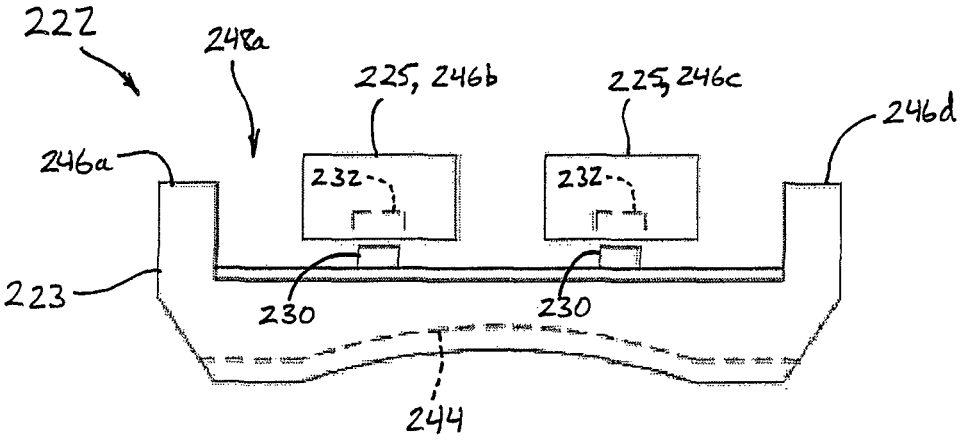
FIG. 10B is an end elevation of the saddle member of FIG. 10A, shown with stabilizer blocks being positioned in spaced arrangement on the saddle member.
Figure 10C:
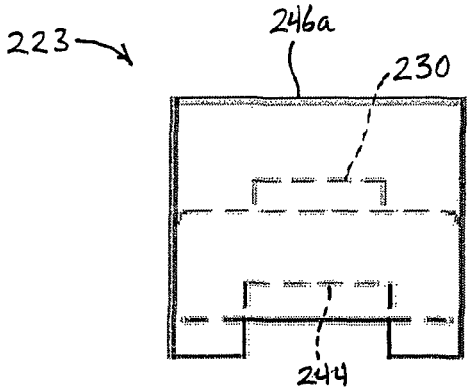
FIG. 10C is a side elevation of the saddle member of FIG. 10A.

Optionally, and with reference to FIGS. 10A-10C, another alternative saddle member 222 is similar to saddle member 122, described above, but can be formed in three parts using simpler molds, and is configured to support cross beams without the use of slide members. In FIGS. 10A-10C, various regions and components of alternative saddle member 222 that are substantially similar to regions and components of saddle member 22 are given like numerals by the addition of 200, such that the regions and components may be understood with reference to the above discussion. Saddle member 222 is made up of a saddle base 223 and a spaced pair of middle stabilizer blocks 225 (FIG. 10B) that form respective walls 246*b*, 246*c* and have rectangular recesses 232 which receive rectangular projections 230 extending upwardly from an upper surface of saddle base 223.

Figure 11A:
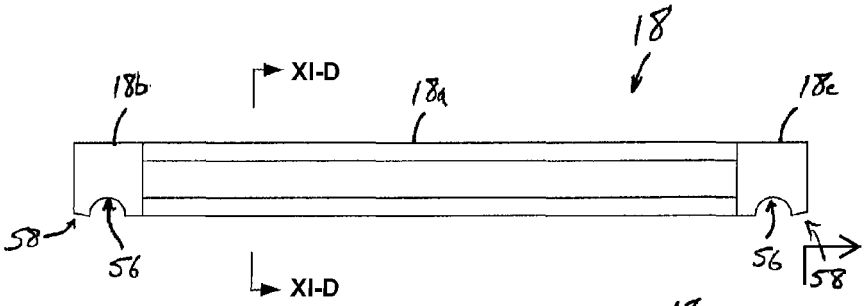
FIG. 11A is a side elevation of a cross beam.
Figure 11B:
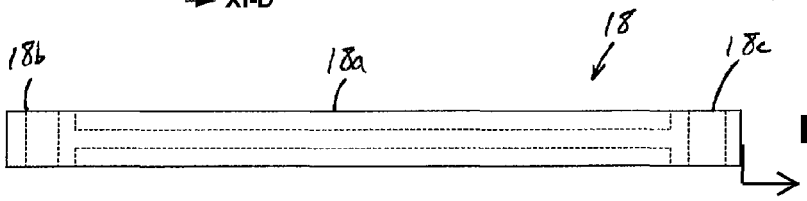
FIG. 11B is a top plan view of the cross beam of FIG. 11A.
Figure 11C:
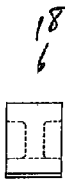
FIG. 11C is an end elevation of the cross beam of FIG. 11A.
Figure 11D:
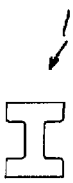
FIG. 11D is an end sectional view taken along line XI-D-XI-D in FIG. 11A.
Figure 11E:
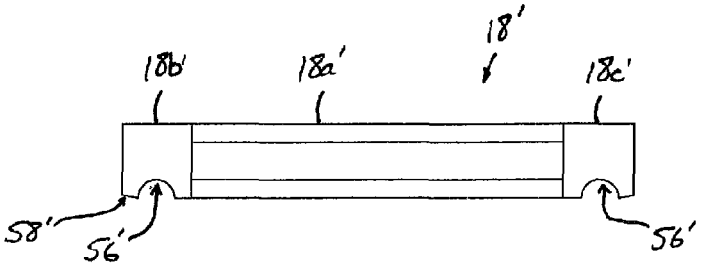
FIGS. 11E and 11F are side elevations of cross beams that are similar to the beam of FIGS. 11A and 11B, but which are shorter in length.
Figure 11F:
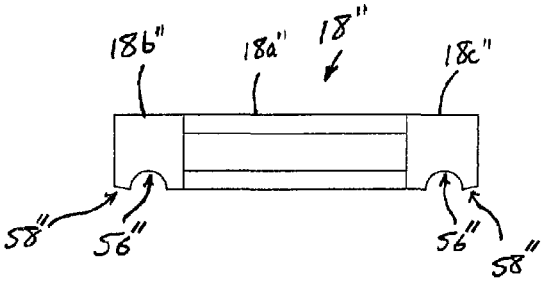
Figure 25:
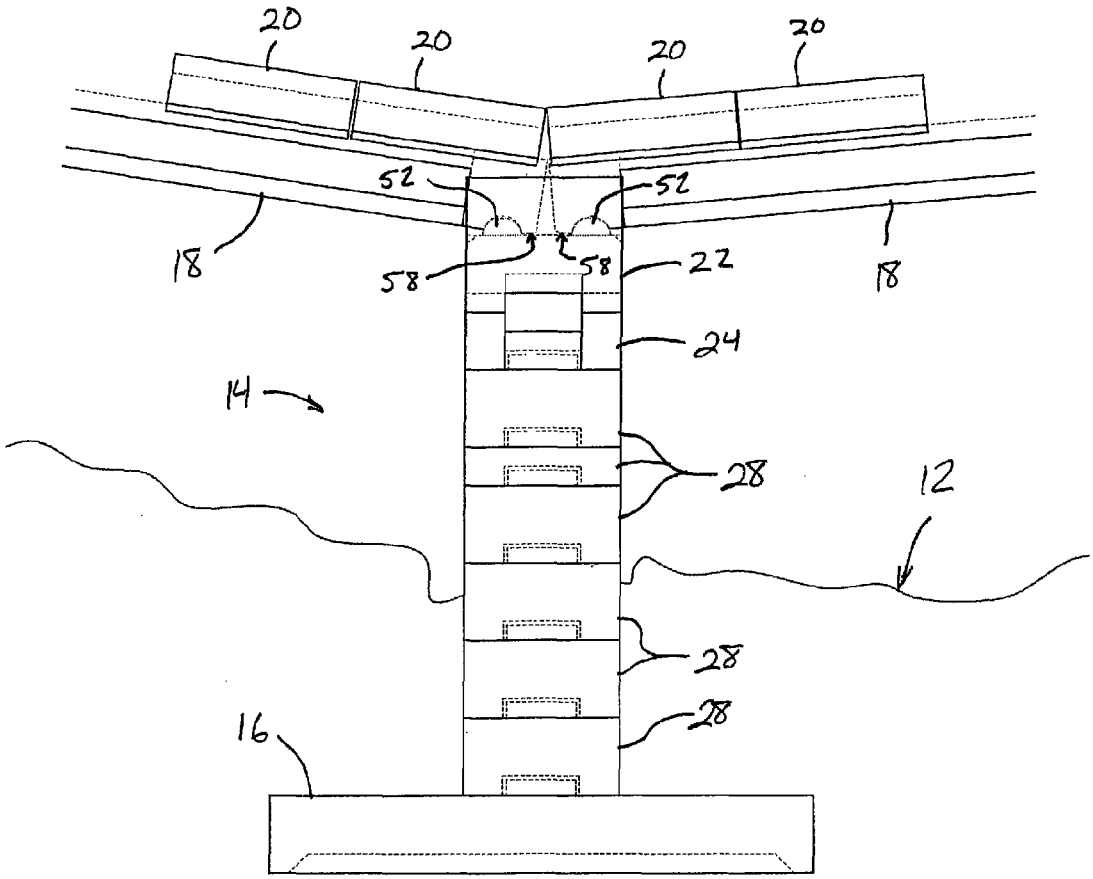
FIG. 25 is the side sectional elevation of the bridge section of FIG. 2, shown with the support column in a sunken but substantially vertical configuration.
Figure 26:
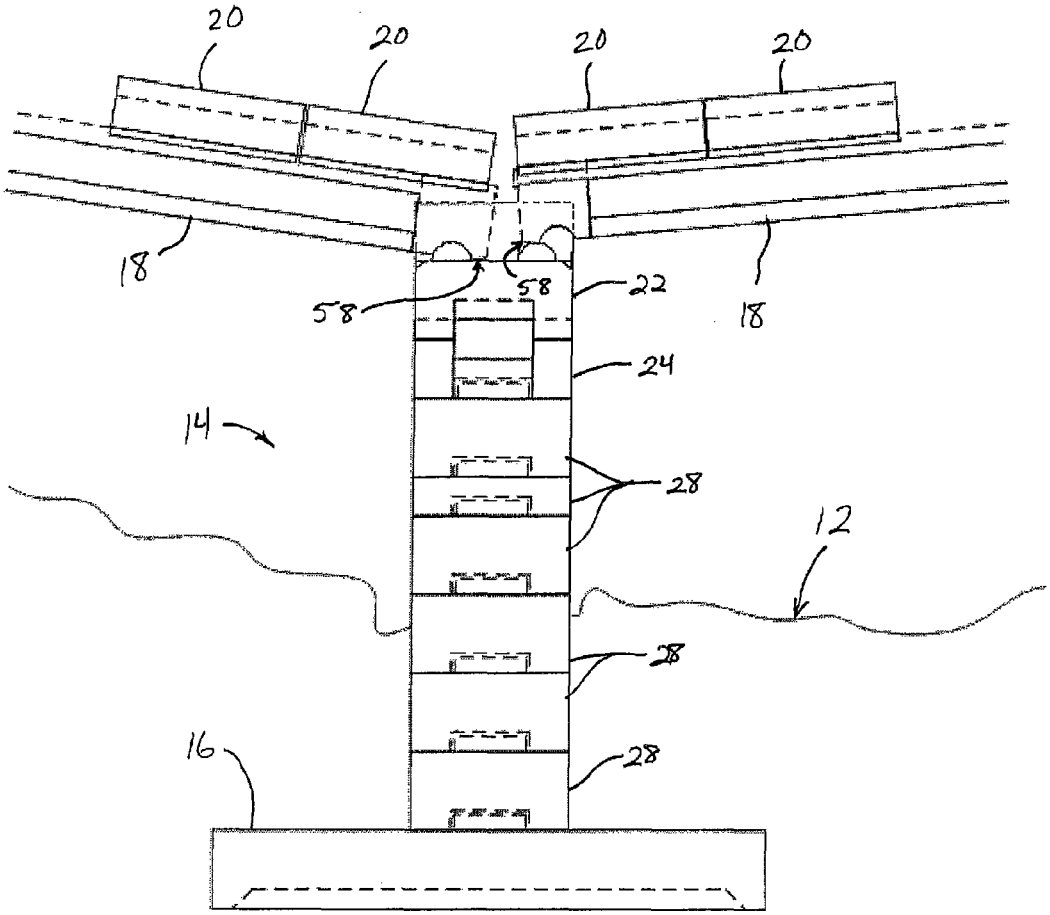
FIG. 26 is another side sectional elevation of the bridge portion of FIG. 2, shown with the support column in a sunken but substantially vertical orientation, and one of the cross beams partially disengaged from the saddle member.

Cross beams 18 span between respective saddle members 22 of respective support column 14, and are supported on movable slide members 52. Each cross beam 18 includes a mid-portion 18*a* and opposite end portions 18*b*, 18*c* (FIGS. 11A-11D). In the illustrated embodiment, beam mid-portion 18*a* is generally in the form of an I-beam to provide high strength at reduced weight. The length of the cross beams may be chosen by changing the length of the mid-portion, such as shown in FIGS. 11E and 11F in which a 15-foot-length beam 18' and a 10-foot-length beam 18" are shown, respectively. End portions 18*c*, 18*b* are mirror images of one another, and each includes a concave lower bearing surface 56 that, in the illustrated embodiment, is partially cylindrical in shape. Concave lower bearing surface 56 of each opposite end portion 18*b*, 18*c* is shaped correspondingly to the convex upper surface of movable slide member 52, and may be manufactured by molding or setting halves of steel pipes into the uncured concrete of the cross beams. Typically, four cross beams 18 are supported at each mid-span support column 14 via engagement of concave lower bearing surfaces 56 of the end portions 18*b*, 18*c* of cross beams 18 with the upper convex surfaces of movable slide members 52. In this manner, the end portions 18*b*, 18*c* of cross beams 18 are supported in the beam-receiving channels 48*a*, 48*b* of each saddle member 22. In addition, a crush-resistant lower corner region 58 acts as a load-bearing surface in the event that concave lower bearing surface 56 of cross beam end portions 18*b*, 18*c* are dislodged or moved into disengagement from movable slide members 52 of saddle members 22, or if the column sinks excessively (FIGS. 25 and 26).

Figure 12A:
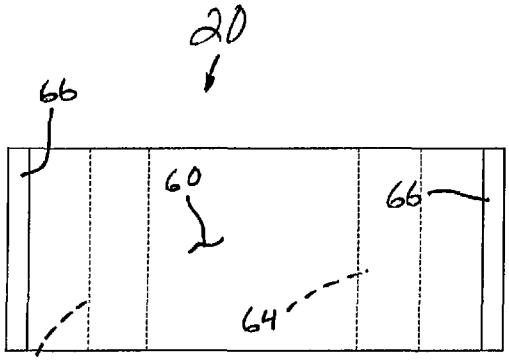
FIG. 12A is a top plan view of a roadway section.
Figure 12B:
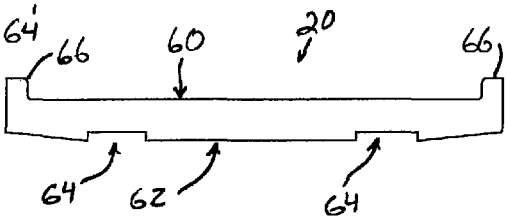
FIG. 12B is an end elevation of the roadway section of FIG. 12A.

Cross beams 18 support a plurality of roadway members 20, each of which includes an upper road surface 60, a lower support surface 62 including a pair of spaced beam-receiving channels 64, and a pair of spaced elongate guides 66 along respective sides of the roadway member 20 (FIGS. 12A and 12B). Upper road surface 60 is intended to be driven upon by vehicles or walked upon by pedestrians and/or livestock, and may be painted or striped with guidelines or the like. Elongate upstanding guides 66 serve as curbs to help prevent pedestrians, livestock, and vehicles from accidentally leaving the road surface 60. Beam receiving channels 64 are spaced by the same distance as beam-receiving channels 48*a*, 48*b* of saddle member 22, and thus are spaced to receive the respective cross beams 18 that support the roadway members 20.

Figure 12C:
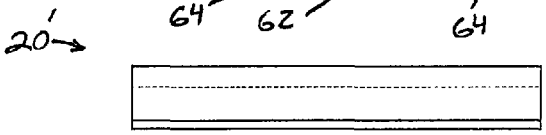
FIG. 12C is a top plan view of a reduced-width roadway section.
Figure 12D:
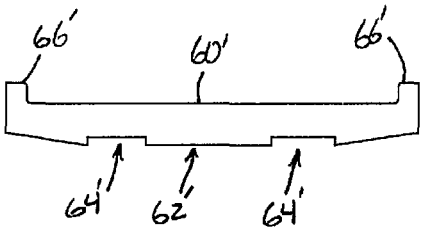
FIG. 12D is an end elevation of the reduced-width section of FIG. 12C.

In the illustrated embodiment of FIGS. 12A and 12B, roadway member 20 is approximately twelve feet wide to provide for approximately one lane of motorized vehicle traffic with space for pedestrians and/or livestock, although it will be appreciated that other widths of roadway member may be provided, such as a ten foot wide roadway member 20', as shown in FIGS. 12C and 12D. Typically, a plurality of roadway members 20 are positioned atop cross beams 18 in an abutting or closely-spaced arrangement to provide a complete and substantially continuous roadway surface 60 from one end of bridge assembly 10 to the other. Optionally, and as shown in FIG. 1, railing portions 68 may be coupled to the upstanding guides or curbs 66 to provide an added degree of safety for pedestrians, livestock, and small vehicles crossing the bridge.

Figure 13A:
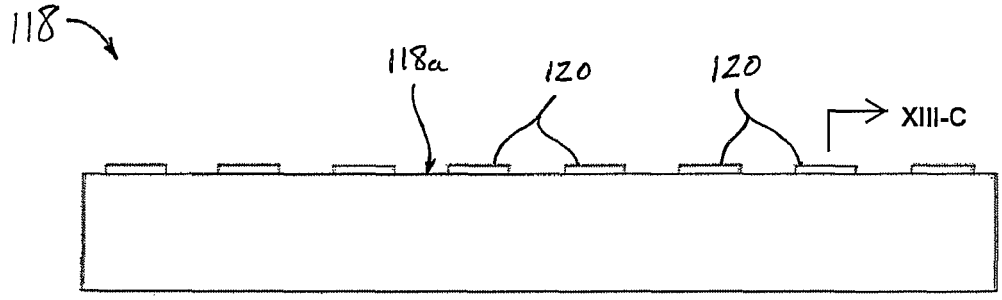
FIG. 13A is a side elevation of an alternative cross beam.
Figure 13B:
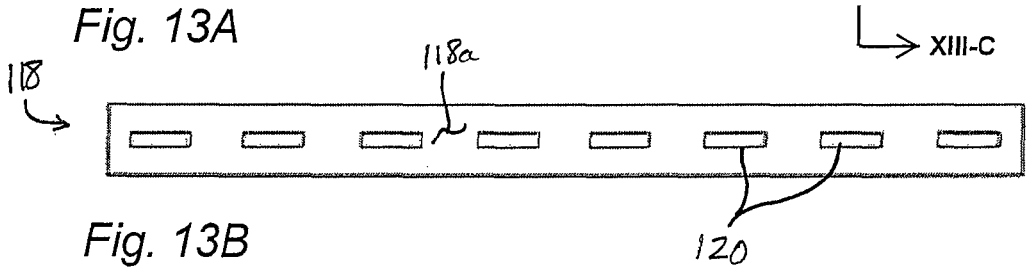
FIG. 13B is a top plan view of the cross beam of FIG. 13A.
Figure 13C:
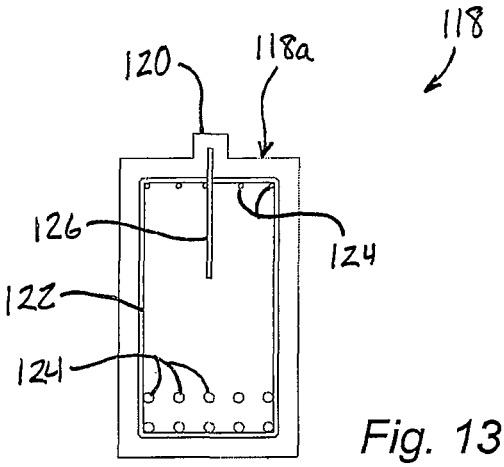
FIG. 13C is an end sectional view of the cross beam of FIG. 13A.

Optionally, and with reference to FIGS. 13A-C, an alternative cross beam 118 is substantially rectangular is cross section, and has a plurality of spaced rectangular projections 120 in a linear arrangement along a top surface 118*a* of the cross beam 118. Unlike cross beam 18, alternative cross beam 118 has a substantially constant cross section and its opposite end portions are intended to lie generally flat on a saddle member, such as either of saddle members 122 or 222, which lack slide members. As shown in FIG. 13C, cross beam 118 includes a generally rectangular reinforcement member 122, typically made of metal such as iron or steel or the like, a plurality of elongate or rod-like reinforcing members 124 disposed inside of the rectangular reinforcing member 122, and a rectangular reinforcing plate 126 that extends substantially the length of each rectangular projection 120. Thus, cross beam 118 may be made substantially from molded concrete, with reinforcing members 122, 124, 126 disposed inside for strengthening the beam.

Figure 14A:
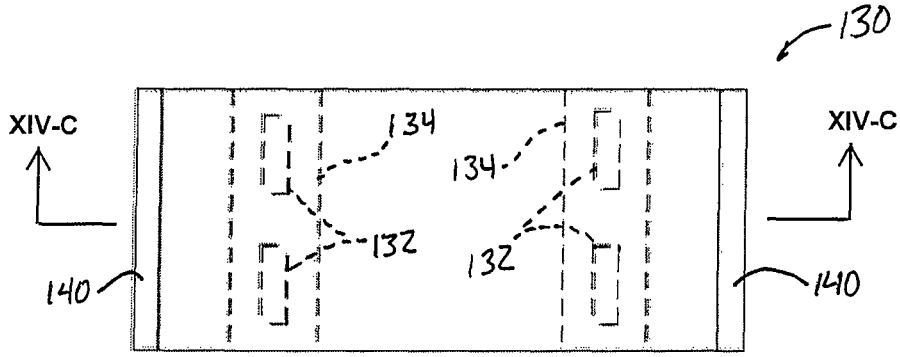
FIG. 14A is a top plan view of an alternative roadway section.
Figure 14B:
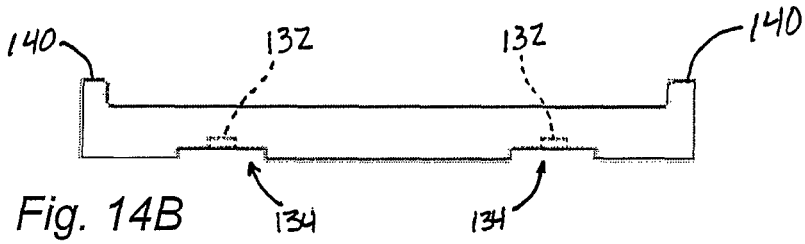
FIG. 14B is an end elevation of the alternative roadway section of FIG. 14A.
Figure 14C:
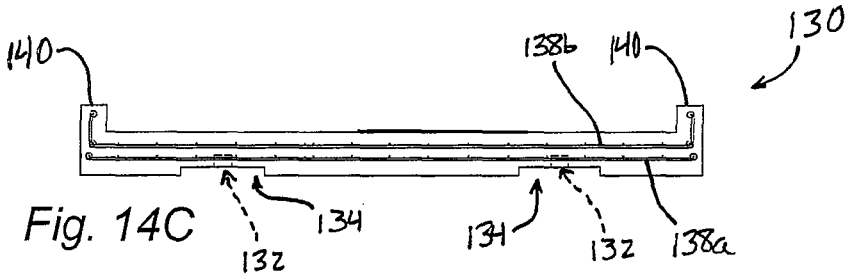
FIG. 14C is an end sectional view of the roadway section, taken along line XIV-C-XIV-C in FIG. 14A.
Figure 15:
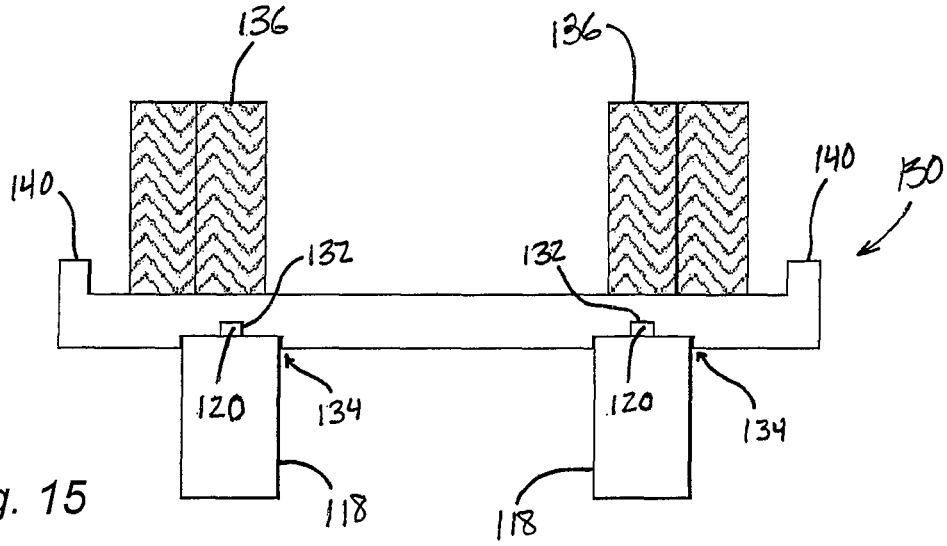
FIG. 15 is an end elevation of the alternative roadway section of FIG. 14A positioned atop the alternative cross beam of FIG. 12A, and with two pair of vehicle tires representing a vehicle positioned on the roadway section.
Figure 16A:
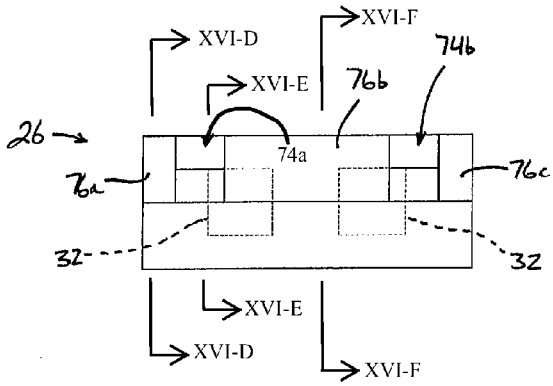
FIG. 16A is a top plan view of a threshold member.
Figure 16B:
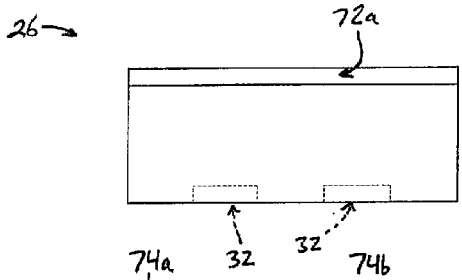
FIG. 16B is an outboard end elevation of the threshold member of FIG. 16A.
Figure 16C:
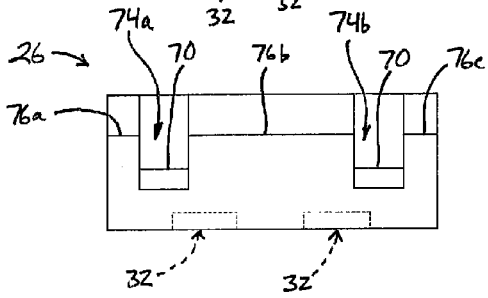
FIG. 16C is an inboard end elevation of the threshold member of FIG. 16A.
Figure 16D:
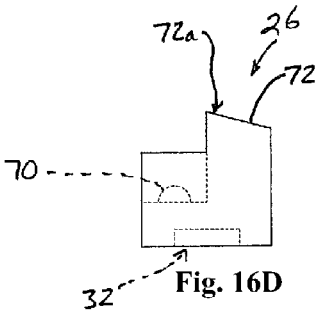
FIGS. 16D-F are side sectional views taken along lines XVI-D-XVI-D, XVI-E-XVI-E, and XVI-F-XVI-F, respectively, in FIG. 16A.
Figure 16E:
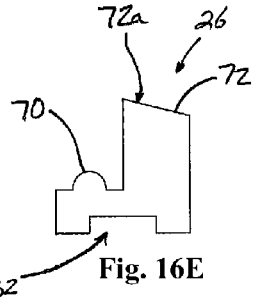
Figure 16F:
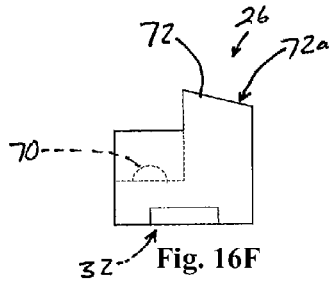

Alternative cross beam 118 is configured for use with roadway members 130 that are substantially similar to roadway members 20, described above, but which include a plurality of spaced rectangular recesses 132 along their spaced beam-receiving channels 134 (FIGS. 14A-14C). Spaced recesses are sized and arranged to receive the spaced rectangular projections 120 of cross beam 118 when the roadway member 130 is positioned atop a pair of cross beams 118 (FIG. 15), so that roadway member 130 is not permitted to slide or move relative to beams 118. This is advantageous, for example, if a vehicle (represented by tires 136 in FIG. 15) were to come to a sudden halt due to a mechanical problem or an obstruction in the roadway. Like cross beam 118, roadway members 130 may be formed from molded concrete, with lengths of metal reinforcement rods 138*a*, 138*b* in spaced arrangement (FIG. 14C). In the illustrated embodiments, reinforcement rods 138*a* are generally straight rods that are oriented laterally across the roadway, and reinforcement rods 138*b* are generally U-shaped with upstanding end portions that extend into spaced elongate guides 140 that are formed along respective sides of the roadway member 130. It will be appreciated that roadway member 130 may further incorporate longitudinally-oriented reinforcement rods or members, such as in a conventional "rebar" arrangement.

Located at each end of bridge assembly 10 is an anchor or threshold member 26, which supports the outermost or outboard ends of the outermost cross beams 18, such as shown in FIG. 1. Threshold members 26 include convex upper bearing surfaces 70 that are partially-cylindrical in shape, and similar or identical in shape to movable slide members 52 of saddle members 22 (FIGS. 16A-16F). Upper bearing surfaces 70 thus support either end portion 18*b*, 18*c* of a given cross beam 18, so that the cross beams may be placed atop a threshold member 26 and a support column 14 without regard to the orientation of the cross beam, as long as the cross beams' concave lower bearing surfaces 44 are facing downwardly. Although convex upper bearing surfaces 70 are non-movable in the illustrated embodiment, it will be appreciated that these partial-cylindrical surfaces could be formed as movable slide members similar to the slide members 52 of saddle members 22.

An upstanding wall 72 transitions vehicles and foot traffic from a road surface leading up to the bridge assembly 10 and onto the roadway members 20, one of which will be positioned closely to the upstanding wall 72 and generally above convex upper bearing surface 70, and above one of opposite end portions 18*b* or 18*c* of the cross beam 18. Upstanding wall 72 may provide a ramped upper surface 72*a* to aid in transitioning vehicles and foot traffic from an unimproved road surface onto the bridge. Similar to saddle members 22, threshold member 26 defines beam-receiving channels 74*a*, 74*b* (FIG. 16C) between shelf portions 76*a-c*. When respective cross beams 18 are positioned in beam-receiving channels 74*a*, 74*b*, the tops of cross beams 18 and the top surfaces of shelf portions 76*a-c* are substantially flush so that together the cross beams and the threshold members support the roadway member 20 positioned closest to upstanding walls 72 of the threshold members 26 with the roadway member positioned at substantially the same height or level as the uppermost portion of upstanding wall 72. Threshold members 26 each include or define a pair of spaced recesses 32 at a lower surface so that the threshold members can be positioned securely atop respective footers 16.

Figure 17A:
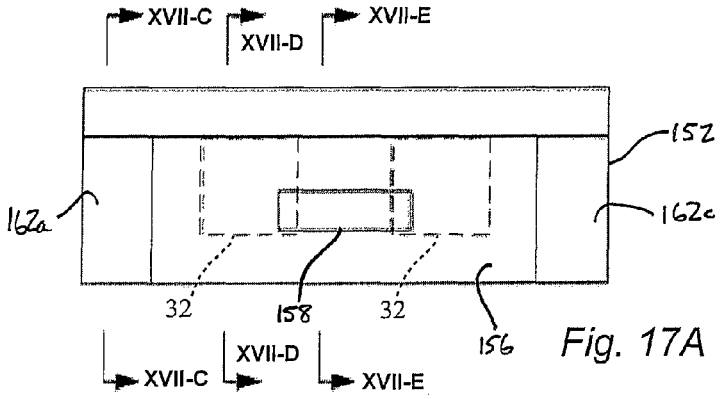
FIG. 17A is a top plan view of an alternative threshold member.
Figure 17B:
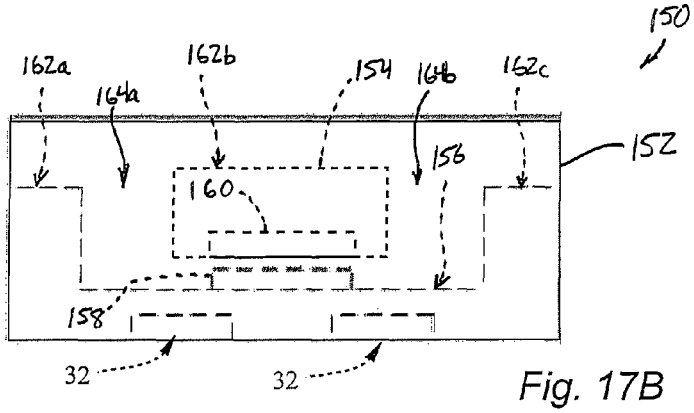
FIG. 17B is an end elevation of the alternative threshold member of FIG. 17A.
Figure 17C:
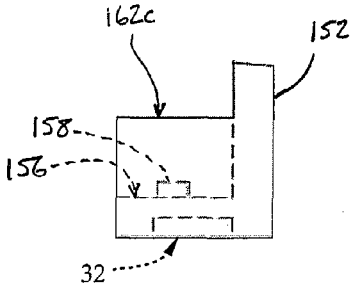
FIGS. 17C-E are side sectional views taken along lines XVII-C-XVII-C, XVII-D-XVII-D, and XVII-E-XVII-E, respectively, in FIG. 17A.
Figure 17D:
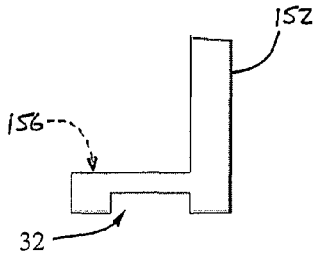
Figure 17E:
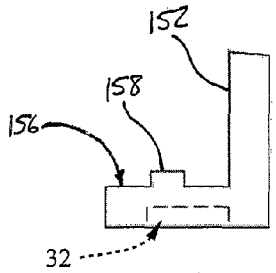

Optionally, and with reference to FIGS. 17A-E, an alternative anchor or threshold 150 is formed as a two-piece assembly including a threshold base 152 and a middle stabilizer block 154 (FIG. 17B). Threshold base 152 includes a central platform portion 156 with an upstanding rectangular projection 158 for engaging a rectangular recess 160 in the bottom surface of middle support 154. With middle stabilizer block 154 lowered fully onto central platform 156, middle support forms a middle shelf portion 162*b* spaced between a pair of outer shelf portions 162*a*, 162*c* to form a pair of beam-receiving channels 164*a*, 164*b*, similar to shelf portions 76*a-c* and beam receiving channels 74*a*, 74*b* of threshold 26, described above. However, threshold 150 lacks convex upper bearing surfaces (although it could include such surfaces), and thus is configured for use with cross beams 118 having flat bottom surfaces at their opposite end portions. Thus, the flat bottom end portions of the cross beams 118 can rest on central platform portion 156 in respective beam-receiving channels 164*a*, 164*b*.

Figure 18A:
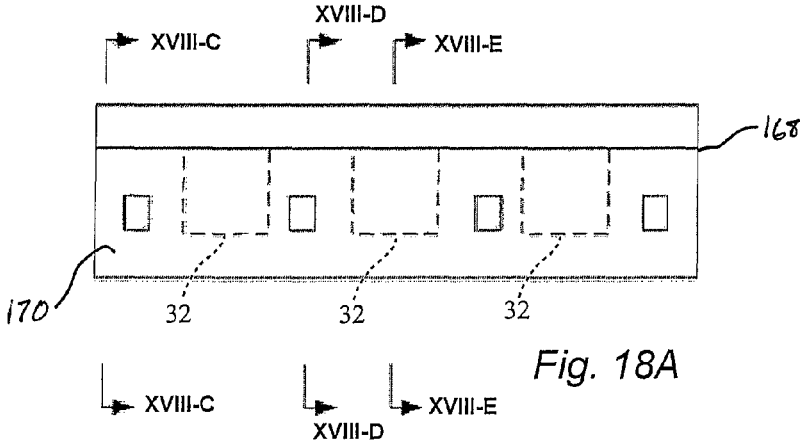
FIG. 18A is a top plan view of another alternative threshold member.
Figure 18B:
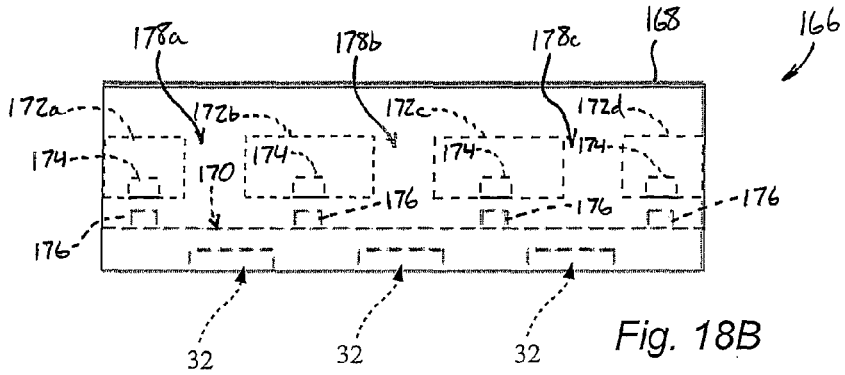
FIG. 18B is an end elevation of the alternative threshold member of FIG. 23A.
Figure 18C:
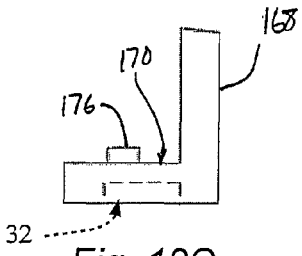
FIGS. 18C-E are side sectional views taken along lines XVIII-C-XVIII-C, XVIII-D-XVIII-D, and XVIII-E-XVIII-E, respectively, in FIG. 18A.
Figure 18D:
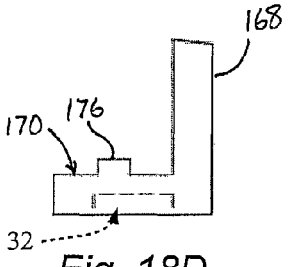
Figure 18E:
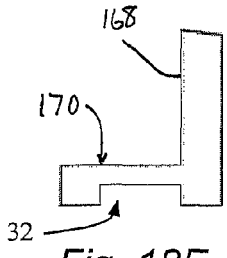

It will be appreciated that the threshold (and all other components) can be dimensioned according to the needs of different bridge applications. For example, a bridge assembly configured to support two lanes of vehicle traffic may use three cross beams to support the wider roadway members, which would typically be formed with three spaced beam-receiving channels in their lower surfaces for receiving the top portions of the cross beams. Likewise, a widened alternative threshold 166 can be assembled in substantially the same way as threshold 150, described above, but with a threshold base 168 forming a platform 170 that receives four stabilizer blocks 172*a-d* including a pair of outer blocks 172*a*, 172*d* and a pair of middle blocks 172*b*, 172*c* (FIG. 18B). Stabilizer blocks 172*a-d* have rectangular recesses 174 formed in their lower surfaces, and threshold base 168 has four upstanding rectangular projections 176 along platform 170, to facilitate positioning and securing the supports in fixed locations along the platform.

Stabilizer blocks 172*a-d* form three beam-receiving channels 178*a-c* (FIG. 18B) so that the end portions of cross beams can rest on platform 170 in the channels 178*a-c*. Stabilizer blocks 172*a-d* may have substantially the same height as that of the cross beam end portions, so that when the cross beams are installed at the threshold 166, the top surfaces of the cross beam end portions are substantially flush with the top surfaces of the stabilizer blocks 172*a-d*. This facilitates installation of roadway members atop stabilizer blocks 172*a-d* and cross beams 118 at threshold 166, so that a smooth transition can readily be made from the bridge's upper road surface to the threshold and then onto a road or trail leading up to the bridge.

The various components of the bridge assembly may be made substantially or entirely from cast concrete, including structurally-reinforced concrete such as that described above with reference to cross beam 118 and roadway member 130. If desired, lifting eyes can be placed or formed in the concrete to facilitate lifting the components and positioning them using a crane. Because most of the components of concrete (e.g. cement, sand, aggregate, etc.) are readily obtainable around the world, and may be mixed, poured into molds, and cured without need for any particularly complex or specialized equipment or environmental controls, it is envisioned that the bridge components could be manufactured and transported from substantially anywhere that can be reached by vehicle, including standard or heavy-duty pickup trucks or the like. Thus, costs for building and repair of such bridge assemblies can be substantially reduced by using primarily local labor, transporting the bridge components over land on relatively small vehicles that are able to negotiate unimproved roads if necessary (thus avoiding the need to build improved roads just to reach a bridge build site), and assembling the bridge without need for very large, costly, and hard-to-transport equipment.

Bridge assembly 10 can accept some degree of damage, such as sinking of a support, while remaining at least partially usable until the bridge can be restored. For example, and with reference to FIG. 24 as compared to FIG. 3, the footers 16 under a support column 14 are depicted as having sunken by about two feet along one side, causing the support column to lean or tilt significantly from vertical. Such damage could be caused, for example, by a severe flood or a miscalculation of the geological formation's hardness in the relatively small area below the support column. In this case, cross beams 18 remain substantially unmoved, or move only a small amount, as joint member 24 slides laterally along and under saddle member 22, owing to the joint and saddle members' respective complementary-shaped concave bearing surfaces. Any sinking of support column 14 is compensated by movement of slide members 52 in saddle member 22, which allows saddle member to move relative to the cross beam ends without causing damage to any of the components of the bridge. The bridge can remain generally usable by normal traffic, and the cross beams and roadway remain substantially straight and aligned, although it will be appreciated that it would be appropriate to evaluate and monitor the bridge's integrity and stability until such time as the bridge column and footers can be realigned and stabilized. The saddle member 22 can be temporarily stabilized by adjusting the stop blocks 42 and/or driving wedges 43 between the saddle member 22 and joint member 24 to limit or prevent further movement of the saddle member relative to the joint member.

Realignment and stabilization can readily be accomplished by removing only the roadway members 20 and cross beams 18 that are at least partially supported by the tilted support column 14, unstacking the saddle member 22, joint member 24, and risers 28 from one another, removing the footers 16, and then re-digging and leveling the portion of the geological formation 12 that supports the footers 16. The original footers can then be replaced, followed by the risers, the joint member, the saddle member, the cross beams, and the roadway members. Thus, the bridge does not have to be fully disassembled, and the non-disassembled portions can remain supported by other unaffected columns, when repairs or adjustments are made to just a portion of the bridge.

Referring now to FIG. 25 as compared to FIG. 2, the entire support column 14 and its footers 16 have sunken about two feet straight down so that the column remains substantially vertical. The cross beams 18 and associated roadway members 20 slope downwardly toward the saddle member 22 as the slide members 52 move away from the center of the saddle member, and the concave lower surfaces 56 of the cross beams 18 slide or pivot along the upper convex surfaces of the slide members until the crush-resistant lower corner regions 58 of the cross beams contact the upper surface of the saddle member. The bridge can remain generally usable by at least pedestrian and livestock traffic, and possibly by low-speed vehicle traffic, depending on the severity of the angle defined by the road surfaces that meet above the sunken column. Even in a more severe condition, in which a pair of cross beams on one side of a sunken column partially lifts out of normal engagement with slide members 52 so that the crush-resistant lower corner regions 58 of the cross beams rest atop the slide members (FIG. 26), the bridge may remain available for limited use until it can be repaired. It will be appreciated that the sunken column can be re-set in substantially the same manner as described above with respect to the tilted column of FIG. 24.

Optionally, and in the event of damage so severe that portions of the bridge assembly are toppled, making the bridge unusable, the bridge assembly components themselves may be largely undamaged, particularly if they fall into water, sand, or another soft surface, so that they can be collected and used in rebuilding the bridge assembly. Any bridge components that are lost or damaged can be replaced with new components, so that repair or replacement of the bridge can be accomplished relatively quickly without waiting for all new components to be transported from long distances. In addition, and because the bridge assembly may be built substantially without the use of any mechanical fasteners, it will be appreciated that damage, toppling, or partial-sinking of one portion of the bridge assembly will not necessarily result in damage to other portions of the bridge assembly. For example, if only one support column is damaged, toppled, or sunken, the cross beams associated with that column may shift or even fall, but this typically would not affect other support columns because the bridge components are held in place by gravity, and not by mechanical fasteners. Thus, damage to the bridge assembly may be minimized and may only affect a small portion of the bridge, which minimizes the effort needed to repair the bridge.

Therefore, the present invention provides a bridge assembly that can be readily assembled from a relatively small number of components arranged together to span substantially any size and type of geological formation, and which can still function after limited damage, or can be readily repaired or rebuilt after being partially toppled, such as during a severe flood or the like. The bridge components can be pre-formed out of concrete near the location where the bridge is ultimately installed, and can typically be built using primarily local labor, whether skilled or relatively unskilled.

Changes and modifications in the specifically described embodiments can be carried out without departing from the principles of the present invention, which is intended to be limited only by the scope of the appended claims, as interpreted according to the principles of patent law including the doctrine of equivalents.

The invention claimed is:

1. A damage-resistant bridge assembly comprising:

a support column supported at a support surface;

a saddle member positioned at an upper end portion of said support column, said saddle member having a main body portion defining a lower bearing surface configured to engage said support column, and said saddle member further having a movable slide member that is repositionable along said main body portion and defining an upper bearing surface of said saddle member;

a cross beam having first and second opposite end portions, wherein said first opposite end portion includes a lower bearing surface for pivoting engagement with said upper bearing surface of said saddle member when said first opposite end portion is positioned at said saddle member; and wherein said movable slide member and said first opposite end portion of said cross beam are configured to translate together, relative to said main body portion of said saddle member, via sliding engagement of said movable slide member along said main body portion of said saddle member, when said support column is moved relative to said cross beam.

2. The bridge assembly of claim 1, wherein said saddle member and said first opposite end portion of said cross beam are configured to move relative to one another via both pivoting and sliding engagement of said upper bearing surface of said saddle member along said lower bearing surface of said first opposite end portion of said cross beam when said support column is moved relative to said cross beam.

3. The bridge assembly of claim 2, wherein said main body portion of said saddle member defines a channel with substantially closed ends for slidably receiving said movable slide member and for permitting a limited range of travel of said movable slide member relative to said main body portion.

4. The bridge assembly of claim 1, wherein said support column comprises a joint member positioned at an upper end thereof, said joint member having an upper bearing surface and said saddle member having a lower bearing surface configured to engage said upper bearing surface of said joint member, and wherein said joint member and said saddle member are configured to move relative to one another via sliding engagement of said upper bearing surface of said joint member along said lower bearing surface of said saddle member when said support column is moved relative to said cross beam.

5. The bridge assembly of claim 1, wherein said support column comprises at least an uppermost riser and a lowermost riser in a generally vertically stacked arrangement.

6. The bridge assembly of claim 5, wherein said joint member is positioned directly on said uppermost riser of said support column.

7. The bridge assembly of claim 5, further comprising at least one footer positioned below said lowermost riser for supporting said lowermost riser at the support surface.

8. The bridge assembly of claim 7, further comprising:

a plurality of said footers;

a footer adaptor positioned between said plurality of footers and said lowermost riser; and wherein said footer adaptor is configured to spread loads from said support column to said plurality of footers.

9. The bridge assembly of claim 8, further comprising at least two of said footer adaptors arranged in two layers between said plurality of footers and said lowermost riser.

10. The bridge assembly of claim 4, wherein said upper bearing surface of said joint member comprises a partial-cylindrical surface having a radius of curvature, and wherein said lower bearing surface of said saddle member comprises a partial-cylindrical surface having a radius of curvature that generally corresponds to the radius of curvature of said partial-cylindrical surface of said upper bearing surface of said joint member.

11. The bridge assembly of claim 10, wherein said partial-cylindrical surface of said joint member is convex, and wherein said partial-cylindrical surface of said saddle member is concave.

12. The bridge assembly of claim 1, wherein said saddle member, said support column, and said cross beam all comprise pre-cast concrete.

13. The bridge assembly of claim 1, wherein said movable slide member is movable along said main body portion of said saddle member in response to movement of said cross beam relative to said main body portion of said saddle member.

14. The bridge assembly of claim 1, wherein said movable slide member comprises a partial-cylindrical surface having a radius of curvature, and wherein said lower bearing surface of said first opposite end portion of said cross beam comprises a partial-cylindrical surface having a radius of curvature that generally corresponds to the radius of curvature of said partial-cylindrical surface of said slide member.

15. The bridge assembly of claim 14, wherein said partial-cylindrical surface of said slide member is convex, and wherein said partial-cylindrical surface of said lower bearing surface of said first opposite end portion of said cross beam is concave.

16. The bridge assembly of claim 15, wherein said partial-cylindrical surface of said slide member and said partial-cylindrical surface of said lower bearing surface of said first opposite end portion of said cross beam are both formed from portions of cylindrical metal pipe.

17. The bridge assembly of claim 4, wherein said support column, said joint member, said saddle member, and said cross beam all comprise pre-cast concrete.

18. The bridge assembly of claim 4, further comprising a roadway member positioned along said cross beam.

19. The bridge assembly of claim 18, further comprising a threshold member positioned below said second opposite end portion of said cross beam, said threshold member being supported at the support surface.

* * * * *